US008424997B2

(12) United States Patent
Kobayashi et al.

(10) Patent No.: US 8,424,997 B2
(45) **Date of Patent: *Apr. 23, 2013**

(54) RECORDING DEVICE, CONTROL METHOD, AND RECORDING MEDIUM

(75) Inventors: Masato Kobayashi, Sagamihara (JP); Yasuo Sakurai, Yokohama (JP); Nobuyuki Satoh, Yokohama (JP); Tomonori Kimura, Kawasaki (JP); Yuichi Sakurada, Yokohama (JP); Arata Suzuki, Zushi (JP)

(73) Assignee: Ricoh Company, Limited, Tokyo (JP)

( * ) Notice: Subject to any disclaimer, the term of this patent is extended or adjusted under 35 U.S.C. 154(b) by 305 days.

This patent is subject to a terminal disclaimer.

(21) Appl. No.: 12/659,560

(22) Filed: Mar. 12, 2010

(65) Prior Publication Data

US 2010/0231632 A1 Sep. 16, 2010

(30) Foreign Application Priority Data

Mar. 13, 2009 (JP) ..... 2009-061920

(51) Int. Cl.
*B41J 29/393* (2006.01)

(52) U.S. Cl.
USPC ..... 347/19; 347/5; 347/16

(58) Field of Classification Search ..... 347/5, 9, 347/16, 19, 14; 400/636.1
See application file for complete search history.

(56) References Cited

U.S. PATENT DOCUMENTS

| | | | | |
|---|---|---|---|---|
| 7,581,801 | B2 * | 9/2009 | Oike | 347/14 |
| 2004/0036731 | A1 * | 2/2004 | Ready et al. | 347/19 |
| 2004/0075708 | A1 | 4/2004 | Arakawa | |
| 2004/0179885 | A1 * | 9/2004 | Adkins et al. | 400/636.1 |
| 2006/0050099 | A1 | 3/2006 | Murakami et al. | |
| 2008/0068418 | A1 | 3/2008 | Yoshida et al. | |

FOREIGN PATENT DOCUMENTS

| | | |
|---|---|---|
| JP | 4296043 | 10/1992 |
| JP | 11-020263 | 1/1999 |
| JP | 2007-261262 | 10/2007 |

OTHER PUBLICATIONS

Abstract of JP 2004-358759, published on Dec. 24, 2004.
U.S. Office Action dated Mar. 28, 2012, issued in co-pending U.S. Appl. No. 12/659,213.
U.S. Office Action dated Nov. 29, 2012, issued in co-pending U.S. Appl. No. 12/659,213.

* cited by examiner

*Primary Examiner* — Lam S Nguyen
(74) *Attorney, Agent, or Firm* — Harness, Dickey & Pierce P.L.C.

(57) ABSTRACT

A recording device including a carriage head, a recording head installed onto the carriage head, the recording head having an array of nozzles that discharges ink on a recording medium, a transfer roller that transfers the recording medium in a direction along the array of nozzles, a control device that controls rotation of the transfer roller, a first detection roller that detects a rotation position of the transfer roller, and a second detection device that detects a mark printed on the recording medium by the recording head, the control device including a print control device that controls printing the marks on the recording medium in the direction along the array of nozzles from the array of nozzles of the recording head while the carriage and the transfer roller remain still, a calculation device that calculates a correction amount for use in correction of a rotation angle of the transfer roller according to a difference between an actual transfer amount of the recording medium by the transfer roller at a predetermined rotation position obtained by detection of the marks by the second detection device while the transfer roller is in rotation and a theoretical transfer amount of the recording medium at the predetermined rotation position, and a correction device that corrects the rotation angle of the transfer roller using the correction amount.

19 Claims, 16 Drawing Sheets

ROLLER OF A
TRUE CIRCLE

ROLLER OF AN
IRREGULAR FORM

WITH NO ECCENTRICITY

WITH ECCENTRICITY

FIG. 11

| COUNT VALUE | ENCODER VALUE | TRANSFER AMOUNT (COUNT VALUE × LINE GAP; l) | ROTATION ANGLE OF TRANSFER ROLLER (ENCODER VALUE/A) × 360 A; ENCODER VALUE OF ONE ROTATION CYCLE OF TRANSFER ROLLER |
|---|---|---|---|
| 1 | $\alpha$ | 1 × l | ($\alpha$/A) × 360 |
| 2 | $\beta$ | 2 × l | ($\beta$/A) × 360 |
| 3 | $\gamma$ | 3 × l | ($\gamma$/A) × 360 |
| · | · | · | · |
| · | · | · | · |
| N | $\zeta$ | N × l | ($\zeta$/A) × 360 |

ROTATION ANGLE OF TRANSFER ROLLER IS DETERMINED FROM NUMBER OF PLUSES SINCE LIMIT OF RESOLUTION OF SUB-SCANNING ENCODER IS KNOWN

FIG. 13

| MEASURING POINT | THEORETICAL TRANSFER GAP [mm] | ACTUAL TRANSFER GAP [mm] | ACTUAL TRANSFER GAP - THEORETICAL TRANSFER GAP [mm] |
|---|---|---|---|
| (1) | 20 | — | — |
| (2) | | 20 | 0 |
| (3) | | 28 | 8 |
| (4) | | 30 | 10 |
| ..... | | ..... | ..... |
| (7) | | 12 | −8 |
| (8) | | 10 | −10 |
| (9) | | 12 | −8 |
| (10) | | 20 | 0 |

RECORDING DEVICE, CONTROL METHOD, AND RECORDING MEDIUM

BACKGROUND OF THE INVENTION

1. Field of the Invention

The present invention relates to recording devices such as an ink jet printer.

2. Discussion of the Background

A recording device employing an ink jet system records an image on a recording medium by discharging ink from a recording head while moving the recording head back and forth in the primary scanning direction to cause the ink to attach to the recording medium. Then, the recording medium is conveyed in the sub-scanning direction by transfer rollers, etc. to repeat recording in the main scanning direction and form the image on the recording medium.

However, the system of conveying a recording medium by transfer rollers involves a problem such that the assembly and eccentricity of the transfer rollers affect transfer (conveyance) of the recording medium. When the transfer amount of the recording medium varies, the image is formed at a position different from the target (ideal, theoretical) recording position on the recording medium.

Therefore, a technology that tried to deal with such a problem describes a method of adjusting the rotation of a transfer roller by recording a test pattern on a recording medium and detecting the shift amount of the recording medium along the transfer direction thereof based on the test pattern.

In this technology, a reference pattern (first pattern: e.g., refer to FIG. 20A) is recorded on a recording medium by nozzles situated on the upstream side in the recording head and an adjustment pattern (second pattern: e.g., refer to FIG. 20B) is recorded on a recording medium by nozzles situated on the downstream side in the recording head. Thus, a patch for adjustment at the first position (phase) of the transfer roller is formed.

Then, a reflection type optical sensor is used to measure the patch to obtain the dot deviation amount at the first position (phase). In addition, the dot deviation amount at the second position (phase) is also obtained by the same procedure. Next, the average deviation amount is calculated from the dot deviation amount at the first position (phase) and the dot deviation amount at the second position (phase). Thereafter, the correct instruction pulse value is calculated from the pulse adjustment value corresponding to the calculated average shift amount and the theoretical instruction pulse value.

The calculated correct instruction pulse value is set as the rotation amount of the transfer roller and the transfer roller is driven based on the pulse value.

However, in this technology, the patch for adjustment is formed while the recording head is moved in the main scanning direction. In addition, the reflection type optical sensor (detection device) is also moved in the main scanning direction in the same manner as in the recording head to calculate the dot deviation amount. Therefore, the average deviation amount calculated based on the dot deviation amount includes the difference ascribable to the movement of the recording head and the reflection type optical sensor. Therefore, no significant reduction in the variation in the sub-scanning direction according to the transfer roller is expected.

SUMMARY OF THE INVENTION

Because of these reasons, the present inventors recognize that a need exists for a recording device, a control method and a program by which the variation in the rotation amount of a transfer roller is reduced along the sub-scanning direction without moving a recording head detection device.

Accordingly, an object of the present invention is to provide a recording device, a control method and a program to reduce the variation in the rotation amount of a transfer roller along the sub-scanning direction without moving a recording head detection device. Briefly this object and other objects of the present invention as hereinafter described will become more readily apparent and can be attained, either individually or in combination thereof, by a recording device including a carriage head, a recording head installed onto the carriage head, the recording head having an array of nozzles that discharges ink on a recording medium, a transfer roller that transfers the recording medium in a direction along the array of nozzles, a control device that controls rotation of the transfer roller, a first detection roller that detects a rotation position of the transfer roller, and a second detection device that detects a mark printed on the recording medium by the recording head, the control device including a print control device that controls printing the marks on the recording medium in the direction along the array of nozzles from the array of nozzles of the recording head while the carriage and the transfer roller remain still, a calculation device that calculates a correction amount for use in correction of a rotation angle of the transfer roller according to a difference between an actual transfer amount of the recording medium by the transfer roller at a predetermined rotation position obtained by detection of the marks by the second detection device while the transfer roller is in rotation and a theoretical transfer amount of the recording medium at the predetermined rotation position, and a correction device that corrects the rotation angle of the transfer roller using the correction amount.

It is preferred that the recording device mentioned above further includes an administration device that administrates the correction amount calculated by the calculation device according to medium conditions of the recording medium, and a selection device that selects the medium conditions of the recording medium for use in image formation, and the correction device determines the correction amount corresponding to the medium conditions selected by the selection device while referring to the administration device and controls the rotation angle of the transfer roller using the correction amount determined.

It is still further preferred that, in the recording device mentioned above, after the marks are printed on the recording medium, the print control device repeats a process of transferring the recording medium by a positive rotation of the transfer roller in a predetermined rotation amount and a process of printing the marks on the recording medium in the direction along the array of nozzles, thereafter the second detection device detects the marks, and then the calculation device obtains the difference between the actual transfer amount of the recording medium at the predetermined rotation position obtained by detection of the marks by the second detection device and the theoretical transfer amount of the recording medium at the predetermined rotation position by relating to the predetermined rotation position of the transfer roller.

It is still further preferred that, in the recording device mentioned above, after the marks are printed on the recording medium, the print control device repeats a process of transferring the recording medium by rotation of the transfer roller in a predetermined rotation amount and a process of printing the marks on the recording medium in the direction along the array of nozzles, the second detection device detects the marks while the print control device transfers the recording medium, and the calculation device obtains the difference between the actual transfer amount of the recording medium at the predetermined rotation position obtained by detection of the marks by the second detection device while the printing device transfers the recording medium and the theoretical transfer amount of the recording medium at the predetermined rotation position by relating to the predetermined rotation position of the transfer roller.

It is still further preferred that, in the recording device mentioned above, the calculation device determines a first difference corresponding to a current rotation position of the transfer roller and a second difference corresponding to the predetermined rotation position of the transfer roller after rotation according to the relationship between the rotation position of the transfer roller and the difference, and calculates the correction amount by a difference between the first difference and the second difference.

It is still further preferred that, in the recording device mentioned above, the correction device determines a transfer amount obtained by subtracting the correction amount from a theoretical transfer amount of the transfer roller between the current rotation position of the transfer roller and the rotation position of the transfer roller after rotation as an actual transfer amount by the transfer roller, and the control device controls rotation of the transfer roller in such a manner that the transfer amount of the transfer roller matches the actual transfer amount by the transfer roller.

As another aspect of the present invention, a method of controlling a recording device is provided that includes a carriage head, a recording head installed onto the carriage head, the recording head having an array of nozzles that discharges ink on a recording medium, a transfer roller that transfers the recording medium in a direction along the array of nozzles, a control device that controls the transfer roller, a first detection roller that detects a rotation position of the transfer roller and a second detection device that detects a mark printed on the recording medium by the recording head, the method of controlling a recording device including discharging ink from the array of nozzles of the recording head installed onto the carriage to print the marks on the recording medium in the direction along the array of nozzles while the carriage and the transfer roller remain at rest, calculating a correction amount for use in correction of a rotation angle of the transfer roller according to a relationship between an actual transfer amount of the recording medium by the transfer roller at a predetermined rotation position obtained by detection of the marks by the second detection device while the transfer roller is in rotation and a theoretical transfer amount of the recording medium at the predetermined rotation position, and correcting the rotation angle of the transfer roller using the correction amount.

As another aspect of the present invention, a computer-readable recording medium is provided that stores a computer program for executing a control method for a recording device that includes a carriage head, a recording head installed onto the carriage head, the recording head having an array of nozzles that discharges ink on a recording medium, a transfer roller that transfers the recording medium in a direction along the array of nozzles, a control device that controls the transfer roller, a first detection roller that detects a rotation position of the transfer roller and a second detection device that detects a mark printed on the recording medium by the recording head, the control method including discharging ink from the array of nozzles of the recording head installed onto the carriage to print the marks on the recording medium in the direction along the array of nozzles while the carriage and the transfer roller remain at rest, calculating a correction amount for use in correction of a rotation angle of the transfer roller according to a relationship between an actual transfer amount of the recording medium by the transfer roller at a predetermined rotation position obtained by detection of the marks by the second detection device while the transfer roller is in rotation and a theoretical transfer amount of the recording medium at the predetermined rotation position, and correcting the rotation angle of the transfer roller using the correction amount.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein:

FIG. 11 is a diagram illustrating a table structure example of the transfer amount and the rotation angle of the transfer roller;

FIG. 13 is a table illustrating actual transfer gaps, between respective measuring points.

DETAILED DESCRIPTION OF THE INVENTION

First Embodiment

Figure 1:
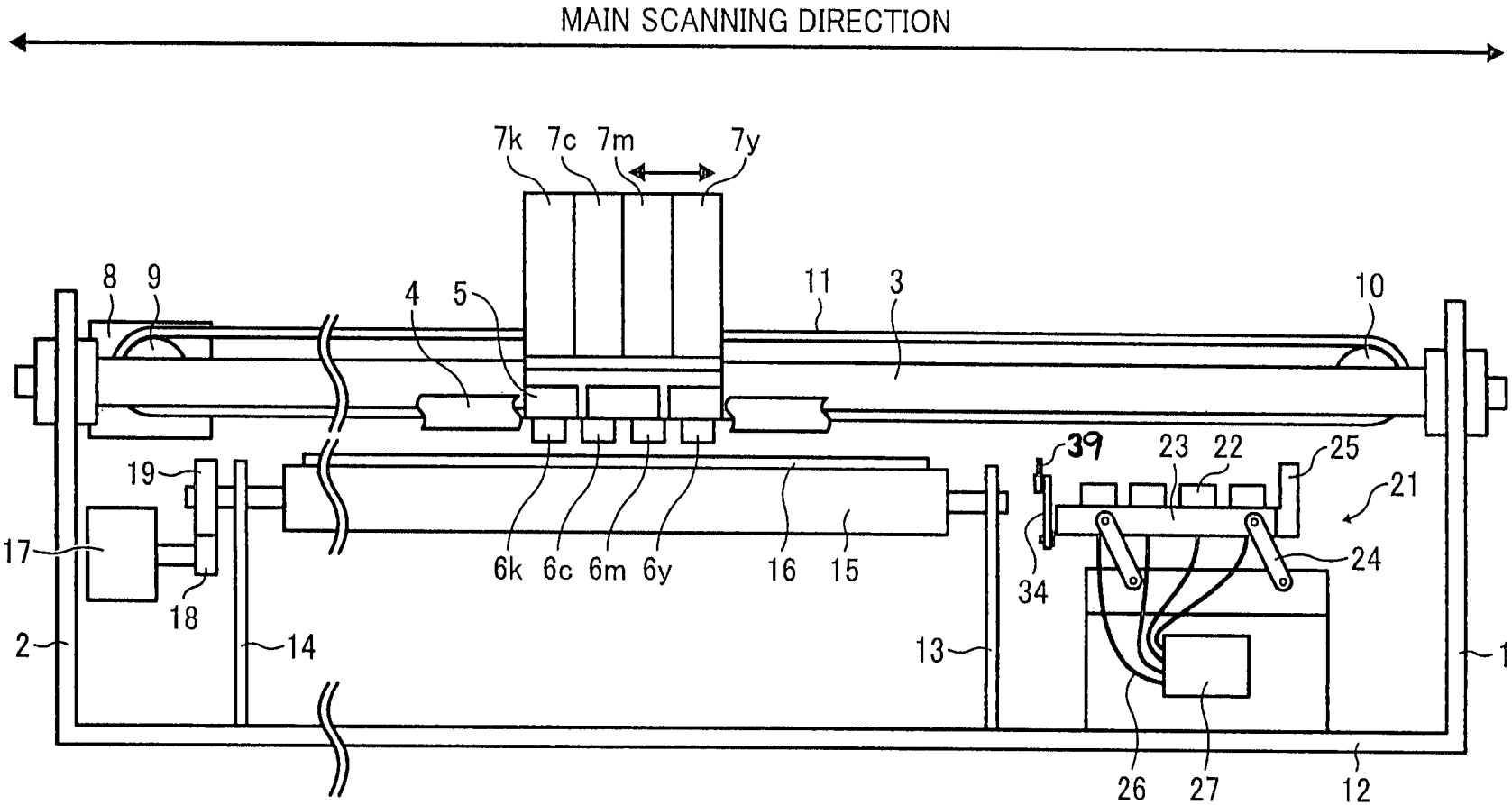
FIG. 1 is a diagram illustrating a schematic structure example of the mechanism of the recording device of the first embodiment described later.

Schematic Structure of Mechanism of Recording Device

The schematic structure of the mechanism of the recording device of this embodiment is described below in detail with reference to FIG. 1.

The recording device of this embodiment includes a main support guide rod 3 and a sub-support guide rod 4 provided in substantially parallel thereto between side plates 1 and 2. The rods 3 and 4 support a carriage 5 such that the carriage 5 slidably moves in the main scanning direction.

The carriage 5 has four recording heads 6*y*, 6*m*, 6*c* and 6*k* that discharge yellow (Y) ink, magenta (M) ink, cyan (C) ink, and black (Bk), respectively, with the discharging surfaces (nozzle phase) thereof downward. In addition, the carriage 5 includes replaceable four ink cartridges 7 (which means any or all of 7*y*, 7*m*. 7*c* and 7*k*) provided above the recording head 6 (which means any or all of 6*y*, 6*m*. 6*c* and 6*k*). The ink cartridge 7 supplies respective inks to the four recording heads 6. The carriage 5 is connected to a timing belt 11 suspended between a driving pulley 9 (drive timing pulley) that is rotated by a main scanning motor 8 and a driven pulley (idler pulley) 10 so that the carriage 5 moves in the main scanning direction by drive-control of the main scanning motor 8.

In addition, the recording device of the embodiment includes a base plate 12, which connects the side plates 1 and 2. Sub-frames 13 and 14 are provided onto the base plate 12 and support the transfer roller 15 that rotates. A sub-scanning motor 17 is provided on the side of the sub-frame 14. A gear 18 is provided fixed onto the rotation axis of the sub-scanning motor 17 and a gear 19 is provided fixed onto the axis of the transfer roller 15 to convey the rotation of the sub-scanning motor 17 to the transfer roller 15.

In addition, a reliability maintenance and recovery mechanism 21 (hereinafter referred to as subsystem) for the recording head 6 is provided between the side plate 1 and the sub-frame 13. The sub-system 21 holds four capping devices that caps the discharging phase of the recording head 6 with a holder 23 and holds the holder 23 with a link member 24 in a shakable manner. The carriage 5 moves in the main scanning direction and when the carriage 5 contacts with an engagement portion 25 provided to the holder 23, the holder 23 is lift up to cap the discharging phase of the recording head 6 by a capping device 22. In addition, when the carriage 5 moves onto the side of the print area, the holder 23 is lift down so that the capping device 22 is detached from the discharging phase of the recording head 6.

The capping device 22 is connected to a suction pump 27 via a suction tube 26 and forms an air opening to communicate with air via an air release tube and an air release valve. In addition, the suction pump 27 suctions waste ink and discharges it to a liquid waste tank.

In addition, on the lateral of the holder 23, a wiper blade 39 that wipes off the discharging phase of the recording head 6 is attached to a blade arm 34. The axis of the blade arm 34 is supported in such a manner that the blade arm 34 can swing by rotation of a cam rotated by a driving force (not shown).

The recording device of this embodiment illustrated in FIG. 1 discharges ink from the recording head 6 while moving the recording head 6 back and forth in the primary scanning direction and causes the ink to attach to the recording medium 16 to record an image thereon. Then, the recording medium 16 is conveyed in the sub-scanning direction by the rotation of the transfer roller 15 to let recording of an image continue in the primary scanning direction and form the entire image on the recording medium 16.

However, a slight deviation occurs with regard to the transfer amount of the recording medium 16 when the recording medium 16 is conveyed by rotating the transfer roller 15. The position on which an image is actually recorded is the result of the actual transfer of the recording medium 16 by the transfer roller 15 in a predetermined amount, and thus is shifted from the ideal position (the target recording position where the image should be recorded on the recording medium 16).

This transfer shift is mainly ascribable to the recording medium 16 and the transfer roller 15.

The transfer shift caused by the recording medium 16 is described first.

The transfer shift relating to the recording medium 16 is caused by, for example, the condition that changes the contact status and the friction status between the recording medium and the transfer roller 15. Specific examples thereof include, but are not limited to, the width of the recording medium 16 (having a size of from, for example, A0 to A5), the thickness, and the friction coefficient. The deviation on the transfer amount of the recording medium is preferably corrected by each condition of the size, thickness, kind, paper quality, etc. of the recording medium 16 since the conditions of the transfer roller 15 in the recording device are fixed.

The transfer shift caused by the transfer roller 15 is described next.

Figure 2:
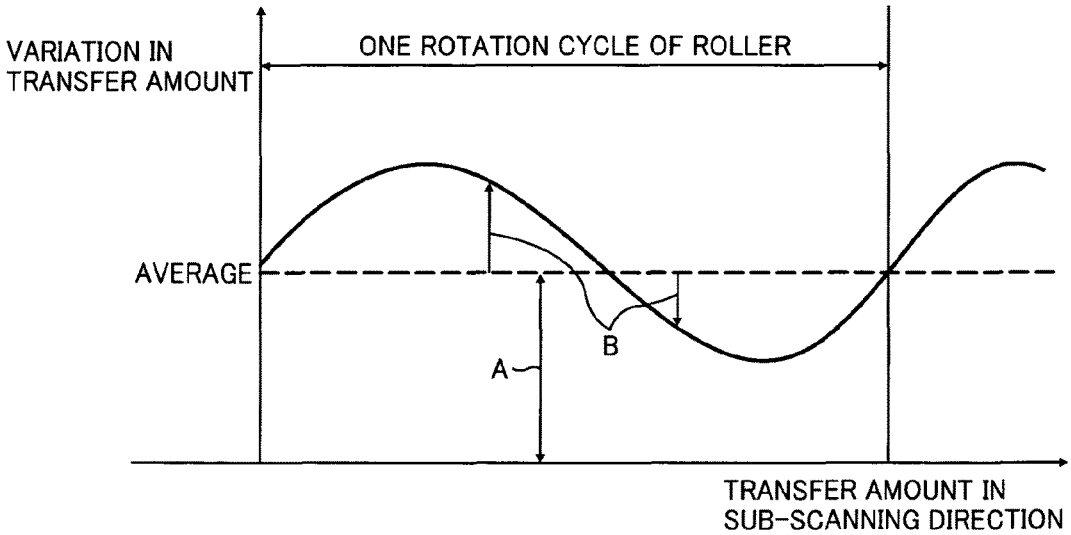
FIG. 2 is a graph illustrating variation in transfer amount by a transfer roller in one cycle thereof.

FIG. 2 is a diagram illustrating the variation of the transfer amount by the transfer roller 15. In FIG. 2, the Y axis represents transfer variation and the X axis represents the transfer amount. As seen in FIG. 2, the transfer amount of the recording medium 16 can be described by the following two compositions.

The first is the fixed composition (i.e., "A" illustrated in FIG. 2) in the roller rotation that depends on the kind of the recording medium 16, the recording device, and the environment.

The second is the variation component (i.e., "B" illustrated in FIG. 2) that relates to one cycle of the roller rotation that depends on the roller precision, the deflection of the roller, and the assembly of the roller support portion. The transfer amount of the recording medium 16 is obtained by addition of the two components and can be approximated.

Since the fixed component ("A" in FIG. 2) depends on the usage environment, the registration should be adjusted in the actual recording environment. On the other hand, the variation component ("B" in FIG. 2) depends on an individual device so that the adjustment is preferably conducted at one time, for example, at the time of shipment.

FIG. 3 is a diagram illustrating the variation in the transfer amount of the recording medium 16 caused by the difference in the form (cross section) of the transfer roller 15. In this case, the rotation angle of the transfer roller 15 that transfers the recording medium 16 is assumed to be constant.

Figure 3A:
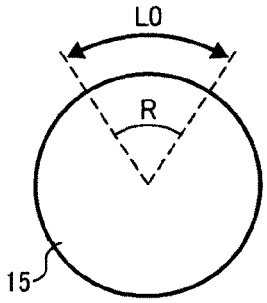
FIGS. 3A-3B is a diagram illustrating the difference in transfer amount by the a transfer roller depending on the forms thereof.
Figure 3B:
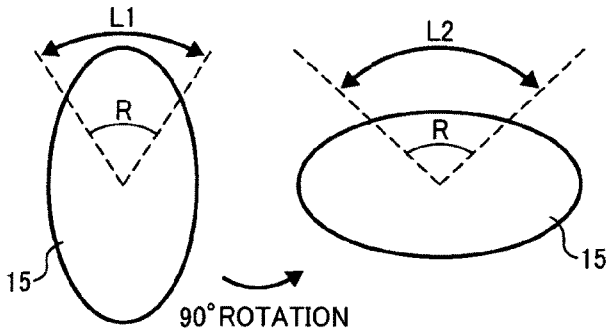

When the cross section of the transfer roller 15 is a true circle, the transfer amount is the same (i.e., L0) at any position as illustrated in FIG. 3A when the transfer roller 15 is rotated at an angle of "R". However, when the cross section of the transfer roller 15 is an irregular form, the transfer amount varies depending on the rotation position of the transfer roller 15 when the transfer roller 15 is rotated at an angle of "R". For example, as illustrated in FIG. 3B, when the cross section of the transfer roller 15 is an ellipse, the transfer roller 16 is transferred in an amount of L1 at a position. The recording medium 16 is transferred in an amount of L2 at another position. In this case, the following relationship is satisfied: L1>L0>L2, and thus the transfer variation occurs depending on the roller cycle. The transfer amounts of L0, L1, and L2 almost match the length of the arcs for the angle "R".

Such a transfer amount variation occurring depending on the roller cycle affects the quality of a resultant printed image. That is, when the transfer amount varies depending on the roller cycle, the landing position of the droplets has a bias depending on the rotation position of the transfer roller 15.

The mechanism of the variation component on the transfer amount relating to one cycle of the transfer roller 15 is described above with reference to FIG. 3 using the difference in the cross sections of the transfer rollers 15 (i.e., a true cycle or an ellipse). The cause of the variation component is not limited to the cross section of the transfer roller 15. For example, the eccentricity of the rotation axis of the transfer roller 15, the deflection of the transfer roller 15, and swelling, or contraction of the transfer roller 15 due to the temperature and the humidity of the surrounding may lead to the occurrence of the variation component.

The impact on the recording caused by the variance in the transfer amount depending on the roller cycle is described next.

When the position of the transfer roller 15 is at L1 as illustrated in FIG. 3B, the transfer amount of the recording medium 16 is greater than usual. Therefore, an image is recorded below (i.e., backward relative to the transfer direction) the position where the image should be recorded.

When the position of the transfer roller 15 is at L2 as illustrated in FIG. 3B, the transfer amount of the recording medium 16 is less than usual. Therefore, an image is recorded above (i.e., forward relative to the transfer direction) the position where the image should be recorded. Therefore, an image having a uniform density results in a shading image. This uneven density significantly stands out in the case of a simple image such as a background of a landscape, which is a disadvantage in terms of quality printing.

Generally, adjustment on the transfer amount represents adjustment with regard to the fixed component (refer to "A" in FIG. 2), which depends on the kind of the recording medium 16, the recording device, and the environment. Also, deviation in the transfer amount is typically detected and obtained by using the adjustment pattern and used as the transfer adjustment value. However, due to the variation component described above, the position where the value of the fixed component is obtained changes depending on the timing of the registration adjustment operation.

Figure 4:
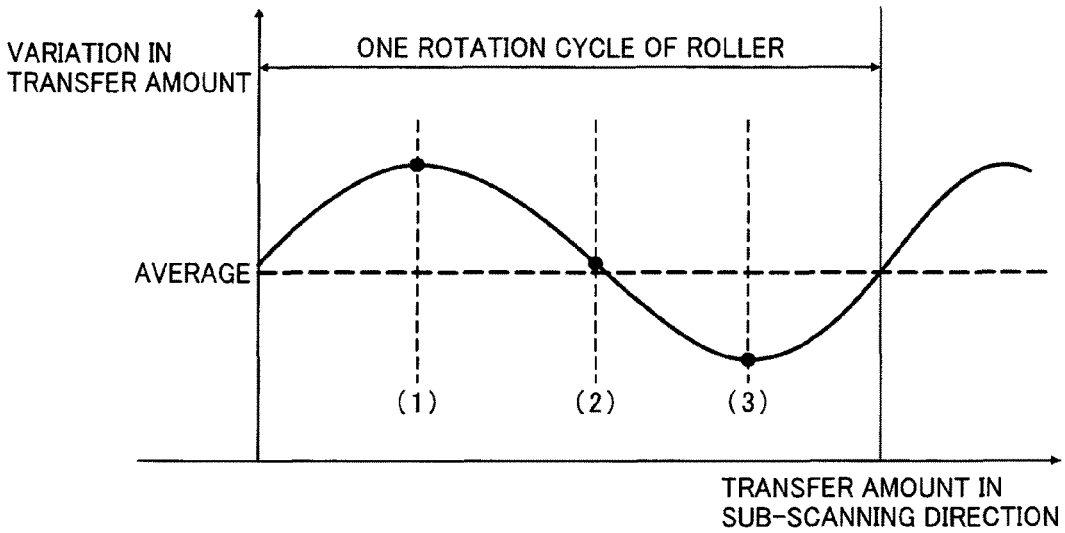
FIG. 4 is a diagram illustrating the variation of the transfer amount (rotation angle) depending on the position (phase) of a transfer roller.

FIG. 4 is a diagram illustrating the variation of the transfer amount according to the position (phase) of the transfer roller 15. When the registration is adjusted at the position (1) in FIG. 4, the obtained adjustment value is greater than the fixed component. When the registration is adjusted at the position (3) in FIG. 4, the obtained adjustment value is smaller than the fixed component. A significantly correct adjustment value corresponding to the fixed component can be obtained by detecting and calculating the transfer amount adjustment value at the position (2) in FIG. 4. However, since the variation component is dependent on the roller precision, the deflection of the roller, and the assembly of the roller support portion, the position is generally difficult to identify.

However, as described above, the transfer amount varies with a cycle corresponding to one rotation of the transfer roller 15. Particularly, as illustrated in FIG. 2, if the variation cycle can be approximated by a cycle of a sin curve, the variation between the two positions corresponding to the ½ rotation of the transfer roller 15 are the same in absolute value with a positive and negative difference.

The recording device of this embodiment detects the variation of the transfer amount caused by the transfer roller 15 and controls the driving thereof based on the detection results. Therefore, the recording device of this embodiment prints multiple marks on the recording medium 16 standing still. The gaps between the multiple marks printed on the recording medium 16 are detected and the variation of the transfer amount of the transfer roller 15 is obtained based on the gaps. According to the detection results, driving of the transfer roller 15 is controlled to adjust the variation of the transfer amount.

Structure Example of Mechanism of Recording Device for Use in Adjustment of Variation of Transfer Amount of Transfer Roller 15

A structure example of the mechanism of the recording device for use in adjustment of the variation of the transfer amount of the transfer roller 15 is described with reference to FIGS. 5 and 6.

Figure 5:
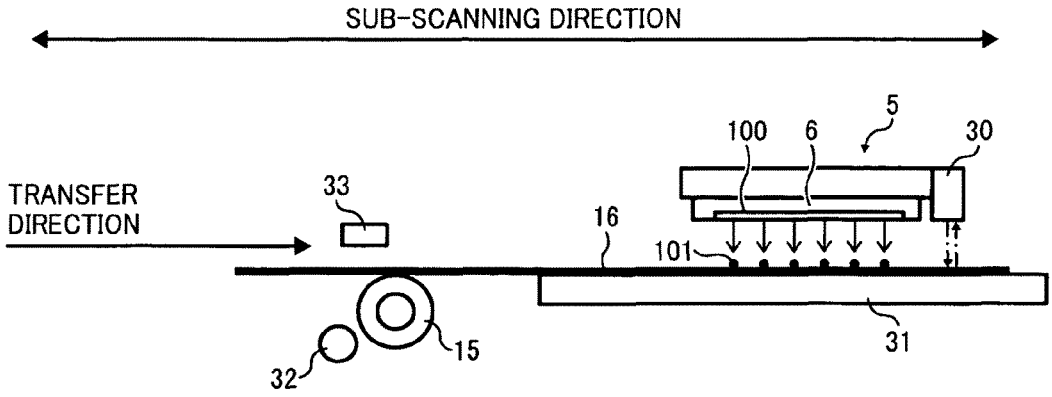
FIG. 5 is another diagram illustrating a schematic structure example of the mechanism of the recording device of the first embodiment described below.
Figure 6:
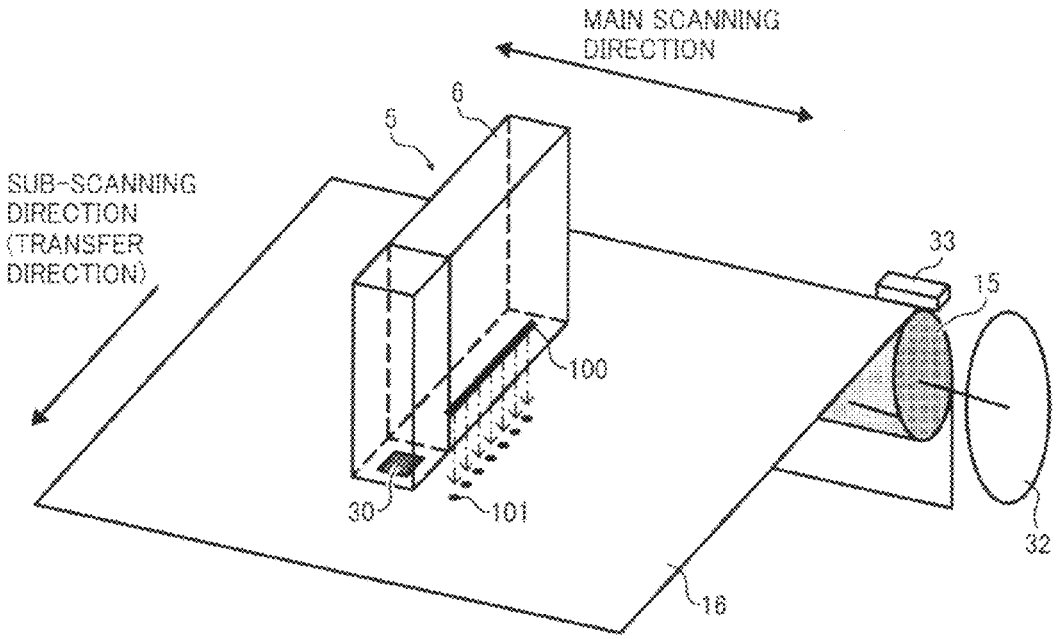
FIG. 6 is yet another diagram illustrating a schematic structure example of the mechanism of the recording device of the first embodiment described below.

The recording device of this embodiment includes the carriage 5, a platen board 31, a transfer roller 15, a sub-scanning encoder 32, and an HP sensor 33 as illustrated in FIGS. 5 and 6.

Figure 7:
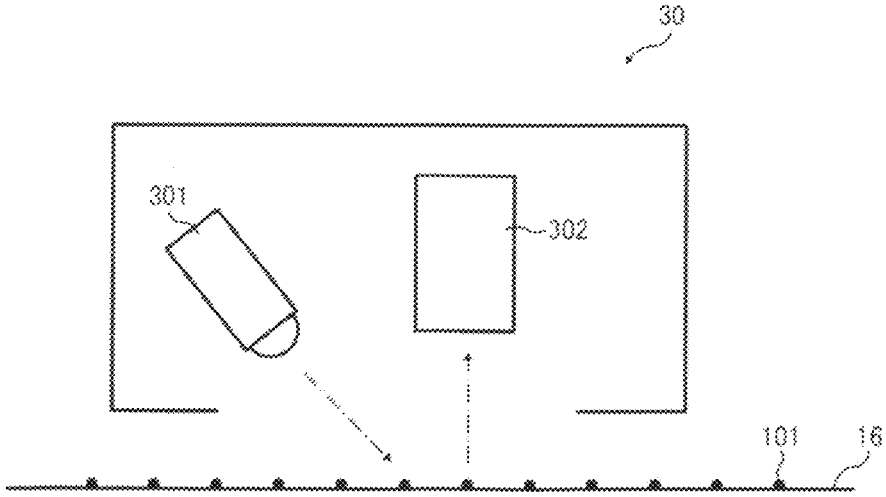
FIG. 7 is a diagram illustrating a structure example of a reading sensor 30, which is described later.

The carriage 5 is structured to have the recording head 6 and a reading sensor 30. The recording head 6 discharges ink from a nozzle 100 to print multiple marks 101 on the recording medium 16. The marks 101 are used when the variation of the transfer amount of the transfer roller 15 is adjusted. The recording sensor 30 detects the marks 101 printed on the recording medium 16. The reading sensor 30 is structured to have a reflection type optical sensor and includes a luminous portion 301 and a light reception portion 302 as illustrated in FIG. 7.

The luminous portion 301 emits light and the light therefrom is reflected at the surface of the recording medium 16. The light reception portion 302 detects the amount of the reflection light (intensity of the reflection light) reflected at the surface of the recording medium 16. The reading sensor 30 detects the marks 101 printed on the recording medium 16 based on the amount (intensity) of reflection light detected by the light reception portion 302.

Any structure of the reading sensor 30 and any detection method thereby that can detect the marks 101 printed on the recording medium 16 can be suitably used. In addition, the reading sensor 30 can be arranged at any position as long as it can detect the marks 101 printed on the recording medium 16 using the recording head 6. For example, the reading sensor 30 can be integrally arranged with the recording head 6 and also can be placed on the extension of the nozzles of the recording head 6.

The transfer roller 15 transfers the recording medium 16. The sub-scanning encoder 32 is to output encoder signals according to the rotation angle of the transfer roller 15. The encoder signal is input into DSP (not shown) and the encoder value is counted thereby. For example, when the transfer roller 15 rotates one cycle, the sub-scanning encoder 32 is assumed to count 38,400. The encoder value per 1 degree of the rotation angle of the transfer roller 15 is obtained as nearly 107 (=38,400/360). When the encoder value counted by the DSP is 3,840, the rotation angle of the transfer roller 15 is obtained as close to 36 (=3,840/107).

The recording device of the present invention discharges ink from multiple nozzles 100 of the recording head 6 installed on the carriage 5 and prints the multiple marks 101 on the recording medium 16 (first time) while the carriage 5 and the recording medium 16 are at rest. Next, the transfer roller 15 is positively rotated to move the recording medium 16 at a predetermined distance while the carriage 5 remains still. Then, the recording device discharges ink from the multiple nozzles 100 of the recording head 6 and prints the multiple marks 101 again on the recording medium 16 (second) while the carriage 5 and the recording medium 16 are at rest. The recording device repeats the performance described above and prints the multiple marks 101 on the recording medium 101 (third to "n" times) until the transfer roller 15 rotates at least a full circle.

The recording device reversely rotates the transfer roller 15 when the transfer roller 15 rotates at least a full circle and rotates the transfer roller 15 back to the position (measuring start point) where the printing of the marks 101 started for the first time. Then, the transfer roller 15 is positively to move the recording medium 16, and the marks 101 printed are sequentially detected from the first time printing by the reading sensor 30 to detect the gaps between the marks 101. Based on the detected gaps between the marks 101, the variation of the transfer amount of the transfer roller 15 is detected. According to the detection results, driving of the transfer roller 15 is controlled to adjust the variation of the transfer amount of the transfer roller 15.

Structure Example of Control Mechanism of Recording Device

Figure 8:
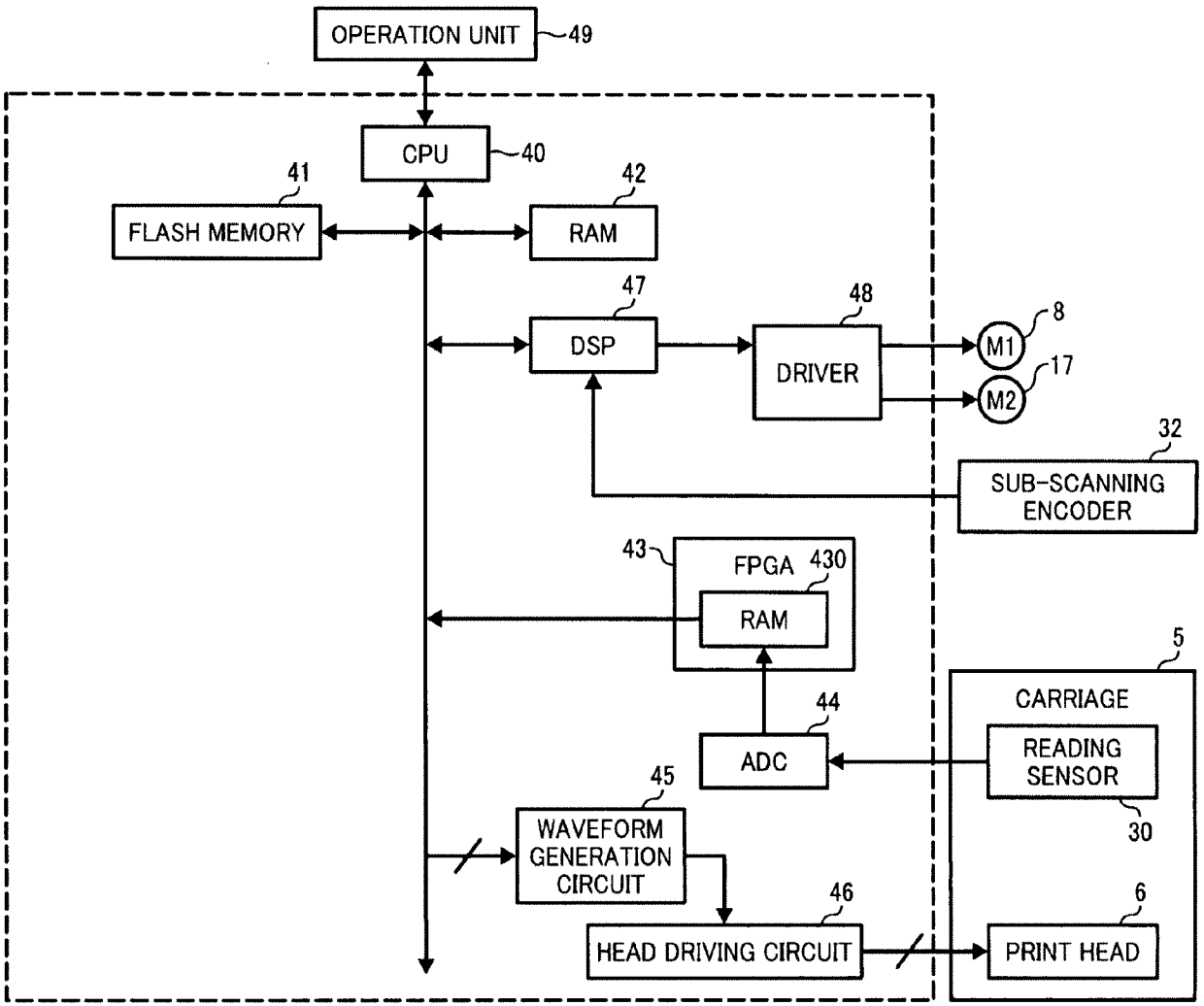
FIG. 8 is, a diagram illustrating a structure example including the control mechanism of the recording device of the first embodiment.

Next, a structure example of the control device (mechanism) of the recording device of this embodiment is described in detail with reference to FIG. 8.

The control device (mechanism) of the recording device of the embodiment includes a print control device, a calculation device, and a correction device, which are a central processing unit (CPU) 40, a flash memory 41, a random access memory (RAM) 42, a field programmable gate array (FPGA) 43, the carriage 5, an analog digital converter (ADC) 44, a waveform generation circuit 45, a head driving circuit 46, the digital signal processor (DSP) 47, and a driver 48. The central processing unit (CPU) 40 and the flash memory 41 form an administration device. The reference number 49 represents an operation unit (selection device).

The CPU 40 controls the entire of the recording device. The flash memory 41 saves necessary information. The RAM 42 is used as a working memory.

FPGA 43 is a large scale integration (LSI) for arbitrary programming and has an RAM 430.

The waveform generation circuit 45 generates a driving waveform applied to a piezoelectric element (not shown) of the recording head 6.

The head driving circuit 46 applies the driving waveform output from the waveform generation circuit 45 to the piezoelectric element (not shown) recording head 6.

The driver 48 drive-controls the main scanning motor 8 and the sub-scanning motor 17 according to the driving information (information on voltage, etc.) provided via the DSP 47 to move the carriage 5 in the main scanning direction, or rotate the transfer roller 15 to transfer the recording medium 16 with a predetermined distance.

Processing Operation of Recording Device

Figure 9:
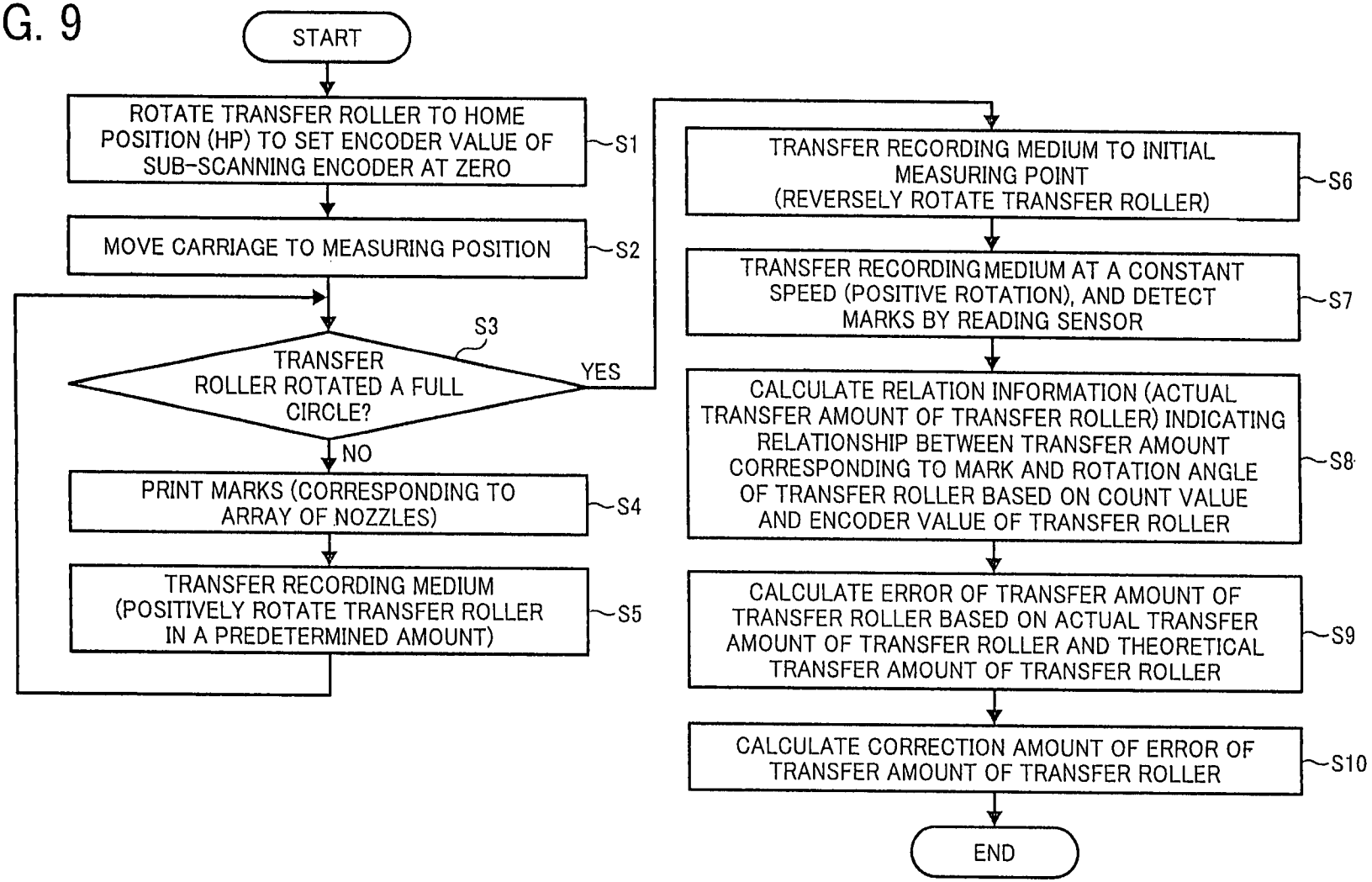
FIG. 9 is a flow chart illustrating a processing example of the recording device of the first embodiment.

Next, the processing operation of the recording device of this embodiment is described next in detail with reference to FIG. 9. FIG. 9 is a flow chart illustrating the processing operation of adjustment on variation of the transfer amount of the transfer roller 15. The variation of the transfer amount is adjusted by a user, etc., who issues an instruction from the operation panel (a selection device) or a personal computer connected to a recording device.

The CPU 40 positively rotates the transfer roller 15 and transfers the recording medium 16 back to the measuring start point (Step S1). The measuring start point is a place where the marks 101 can be printed on the recording medium 16 using the recording head 6. When the recording medium 16 is transferred to the measuring start point, the transfer roller 15 is stopped to transfer the recording medium 16.

When the recording medium 16 is transferred to the measuring start point, the reference position of the transfer roller 15 is detected by using the HP sensor 33, the index signal (Z phase) of the sub-scanning encoder 32, etc., and the positional relationship between the measuring start point and the reference point of the transfer roller 15 is saved in the flash memory 41 so that the CPU 40 recognizes the positional relationship between the measuring start point and the reference point of the transfer roller 15.

The reference position of the transfer roller 15 is referenced as the position of the full circle of the transfer roller 15.

Next, the CPU 40 moves the carriage 5 to the measuring position (Step S2). The measuring position is any point where the transfer amount by the transfer roller 15 is measured in the moving direction of the carriage 5. When the carriage 5 is moved to the measuring position, the carriage 5 is stopped. For example, the carriage 5 is moved to the center portion of the transfer roller 15 in the horizontal direction and then halts.

Next, the CPU 40 determines whether the transfer roller 15 rotates at least a full circle from the reference position (measuring start position) (Step S3). The CPU 40 discharges ink from any of the multiple nozzles 100 of the recording head 6 to print the multiple marks (Step S4) while stopping the carriage 5 and the recording medium 16 when the transfer roller 15 has not rotated a full circle yet from the reference position (measuring start point) (Step S3/No).

The CPU 40 saves the relationship between the rotation position (rotation position from the reference position) of the transfer roller 15 and the gap (the gap between the nozzles that discharged ink) between the marks 101 printed on the recording medium 16 in the flash memory 41. The relationship between the reference position of the transfer roller 15 and the gap between the marks 101 printed on the recording medium 16 is saved in the flash memory 41 for the first time. The actual transfer amount of the recording medium 16 at a predetermined rotation position is obtained according to the relationship between the reference position of the transfer roller 15 and the gap between the marks 101 printed on the recording medium 16 saved in the flash memory 41.

Next, the CPU 40 positively rotates the transfer roller 15 in a predetermined amount to transfer the recording medium 16 (Step S5). For example, the CPU 40 positively rotates the transfer roller 15 such that the recording medium 16 is transferred in a distance longer than the distance of the array of the nozzles. Therefore, the marks 101 can be printed so as not to be overlapped on the marks 101 previously printed on the recording medium 16. When the transfer roller 15 is positively rotated in a predetermined amount, the rotation of the transfer roller 15 is stopped to stop transferring the recording medium 16.

Since the rotation position of the transfer roller 15 from the reference position can be calculated based on the count value of the sub-scanning encoder 32, the CPU 40 saves the rotation position of the transfer roller 15 in the flash memory 41.

The CPU 40 do not stop repeating the process of Step S4 and Step S5 (from S3/No, S4, to S5) before the transfer roller 15 rotates a full circle from the measuring start position of the transfer roller 15. Whether the transfer roller 15 has rotated at least a full circle is determined according to the count value of the sub-scanning encoder 32.

The CPU 40 saves the relationship between the rotation position (rotation position from the reference position) of the transfer roller 15 and the gap between the marks 101 printed on the recording medium 16 in the flash memory 41 every time printing is performed in Step S4.

Figure 10A:
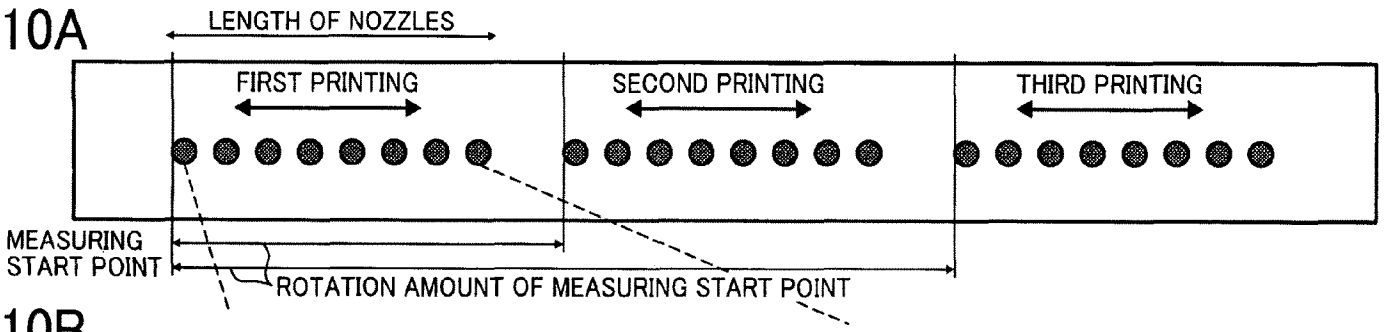
FIGS. 10A-10C is a diagram illustrating an example of the detection signals obtained when a mark 101 printed on a recording medium 100 is detected by the reading sensor 30.

As illustrated in FIG. 10A, the relationship between the reference position (measuring start position) of the transfer roller 15 and the gap between the marks 101 printed on the recording medium 16 at the time is saved in the flash memory 41 for the first time printing. Subsequent to the first time printing, the relationship between the rotation position from the reference position (measuring start position) of the transfer roller 15 and the gap between the marks 101 printed on the recording medium 16 at the time is saved in the flash memory 41

Therefore, the position information (the rotation position from the reference position (measuring start position) of the transfer roller 15 and the gap between the marks 101 printed on the recording medium 16 at the time) corresponding to the rotation amount of the transfer roller 15 is saved in the flash memory 41.

When the transfer roller 15 rotates at least a full circle from the reference position (measuring start position) of the transfer roller 15 (Step S3/Yes), the CPU 40 reversely rotates the transfer roller 15 to move the recording medium 16 to the reference position (measuring start position) (Step S6).

When the recording medium 16 has moved to the reference position (measuring start point), the transfer roller 15 stops. The CPU 40 moves the recording medium 16 based on the positional relationship between the measuring start position and the reference position of the transfer roller 15 saved in the flash memory 41.

Next, the CPU 40 positively rotates the transfer roller 15 at a constant speed to detect the marks 101 printed on the recording medium 16 by the reading sensor 30 attached to the downstream side of the recording head 6 (Step S7).

Figure 10B:
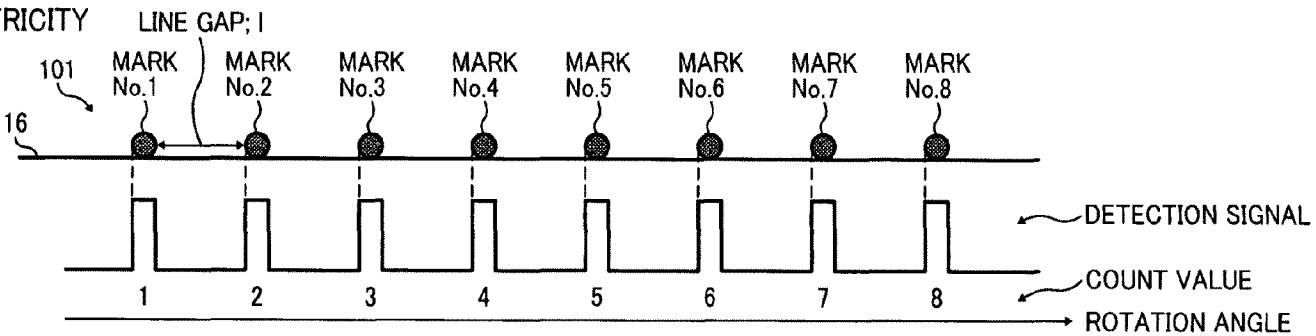
Figure 10C:
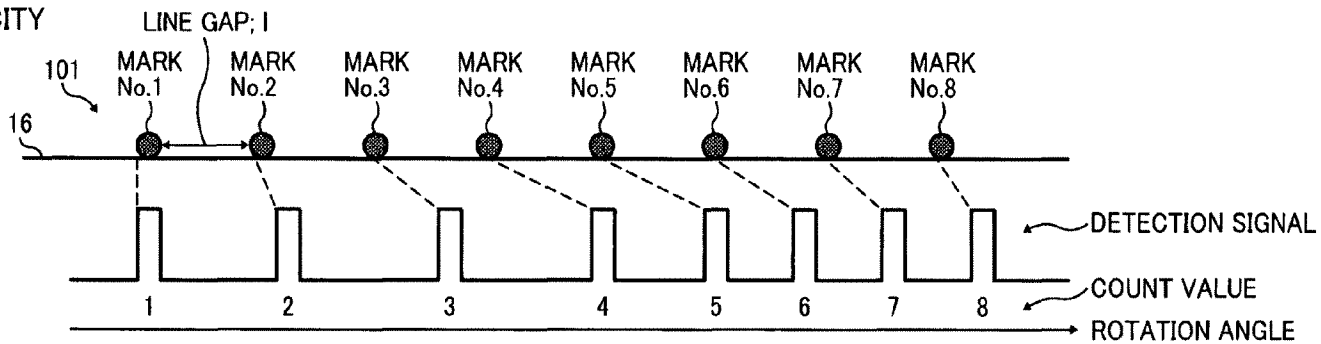

When the marks 101 printed on the recording medium 16 illustrated in FIG. 10A is detected by the reading sensor 30, the reading sensor 30 obtains detection signals as illustrated in FIG. 10B or 10C. An FPGA 43 adds up the count value every time the reading sensor 30 detects the mark 101. The detection signals illustrated in FIG. 10B have no eccentricity and are thus obtained when the transfer amount by the transfer roller 15 has no variation difference. When the transfer roller 15 has no eccentricity, the transfer amount is constant with no variation. Therefore, as illustrated in FIG. 10B, the detection signals having the same gap are obtained. In addition, the detection signals illustrated in FIG. 10C is obtained when the transfer amount by the transfer roller 15 having eccentricity has a variation difference. When the transfer roller 15 has eccentricity, the transfer amount by the transfer roller 15 has variation. Therefore, as illustrated in FIG. 10C, no detection signals having the same gap are obtained.

When the reading sensor 30 detects the marks 101, the CPU 40 reads the count value of the mark 101 from a RAM 430 of the FPGA 43 and in addition the encoder value from the DSP 47. When the reading sensor 30 detects the first mark 101, the CPU 40 reads the count value of 1 from the RAM 430 of the FPGA 43 and in addition the encoder value of alpha counted by the DSP 47 therefrom. Similarly, when the reading sensor 30 detects the second mark 101, the CPU 40 reads the count value of 2 from the RAM 430 of the FPGA 43 and in addition the encoder value of beta counted by the DSP 47 from the DSP 47.

Next, the CPU 40 calculates the relationship information indicating the relationship between the transfer amount corresponding to a desired mark 101 and the rotation angle (rotation position) of the rotation roller 15 at the time when the desired mark 101 is detected based on the count value read in Step S7, and the encoder value.

Since the CPU 40 already recognizes the gap "1" between the marks 101 printed on the recording medium 16, the transfer amount corresponding to the desired mark 101 can be obtained by multiplying the count value of the mark 101 by the gap "1". For example, when the count value of the mark 101 is 3, the transfer amount at the time is 3×1. Furthermore, the CPU 40 calculates the rotation angle (rotation position) of the transfer roller 15 based on the encoder value obtained from the sub-scanning encoder 32. For example, when the transfer roller 15 rotates a full circle, the sub-scanning encoder 32 is assumed to count 38,400. In this case, FPGA 43 calculates the rotation angle B by the calculation of (A/38,400)×360 degree based on the encoder value A obtained from the sub-scanning encoder 32.

Figure 12A:
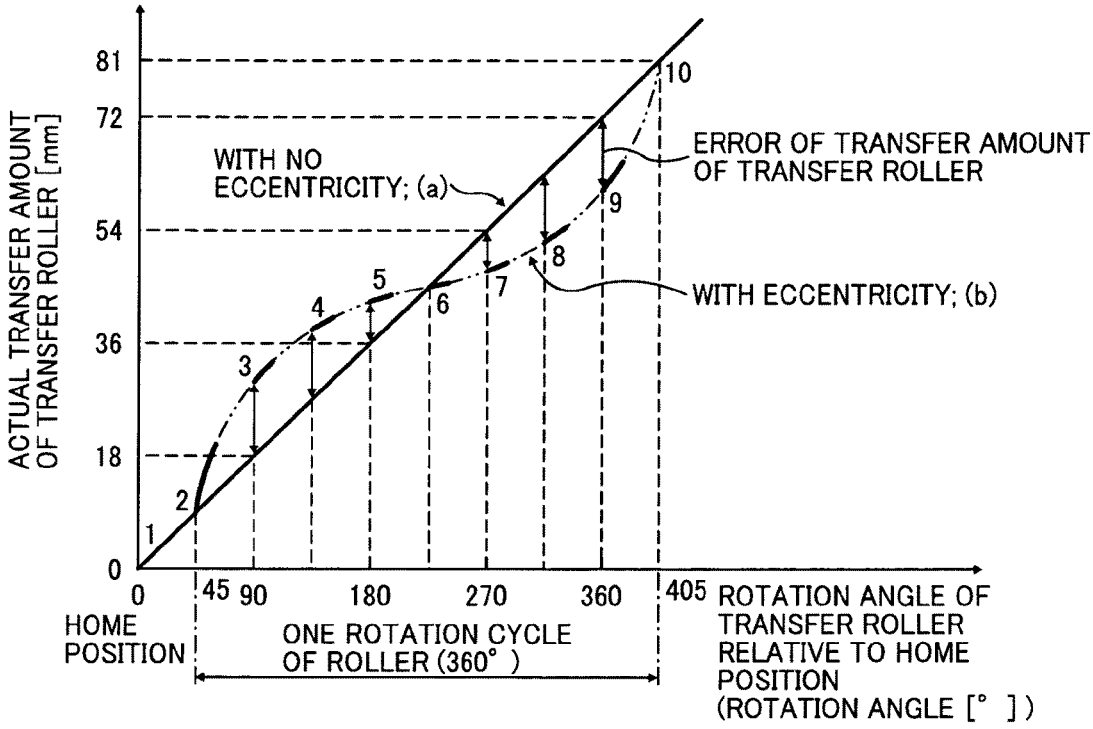
FIGS. 12A-12B is graphs illustrating a calculation method for difference in the transfer amount by a transfer roller.

Therefore, the CPU 40 calculates the transfer amount corresponding to the mark 101 from the count value thereof detected by the reading sensor 30, and obtains the rotation angle of the transfer roller 15 from the encoder value at the time of detection of the mark 101. Then, the relationship information (actual transfer amount of the transfer roller 15) illustrated in FIG. 11 indicating the relationship between the transfer amount corresponding to the mark 101 and the rotation angle of the transfer 15 transfer amount can be calculated (Step S8). The CPU 40 administrates the relation information illustrated in FIG. 11 by the flash memory 41 to obtain the actual transfer amount by the transfer roller 15. In Table 11, Count value, Encoder value, Transfer amount, and Rotation angle of Transfer roller are related. A table in which only Transfer amount and Rotation angle of transfer roller are related is possibly set up. The calculation result of the actual transfer amount by the transfer roller 15 is shown as the graph (b) in FIG. 12A. The Y axis of the FIG. 12A represents the actual transfer amount by the transfer roller 15 and the X axis represents the rotation angle (transfer angle) of the transfer roller 15. The transfer amount illustrated in FIG. 11 corresponds to the Y axis of the graph of FIG. 12A and the rotation angle of the transfer roller 15 illustrated in FIG. 11 corresponds to the X axis of the graph of FIG. 12A.

Next, the CPU 40 calculates the relationship information between any rotation angle (measuring point) of the transfer roller 15 and the actual transfer amount of the transfer roller 15 obtained at the rotation angle based on the information of the correspondence table illustrated in FIG. 11 which is saved in the flash memory 41.

For example, the rotation angles of "1" to "10" pointed in FIG. 12A are set as the measuring points and the actual transfer amounts of the transfer roller 15 obtained at the rotation angles of these measuring points are determined.

Next, the actual gap between each measuring point is obtained.

The gaps between the actual transfer amount between each measuring point are obtained as illustrated in FIG. 13 The gap of the ideal transfer amount is identified in the CPU in advance. Since the ideal transfer amount represents a transfer amount of a transfer roller free from eccentricity, the gap between the measuring points of the rotation angles is constant.

Therefore, the gap between the ideal transfer amount is constant.

Next, the CPU 40 calculates the difference between the gap between the actual transfer amount and the gap of the ideal transfer amount (i.e., gap between the actual transfer amount minus gap of the ideal transfer amount).

Figure 12B:
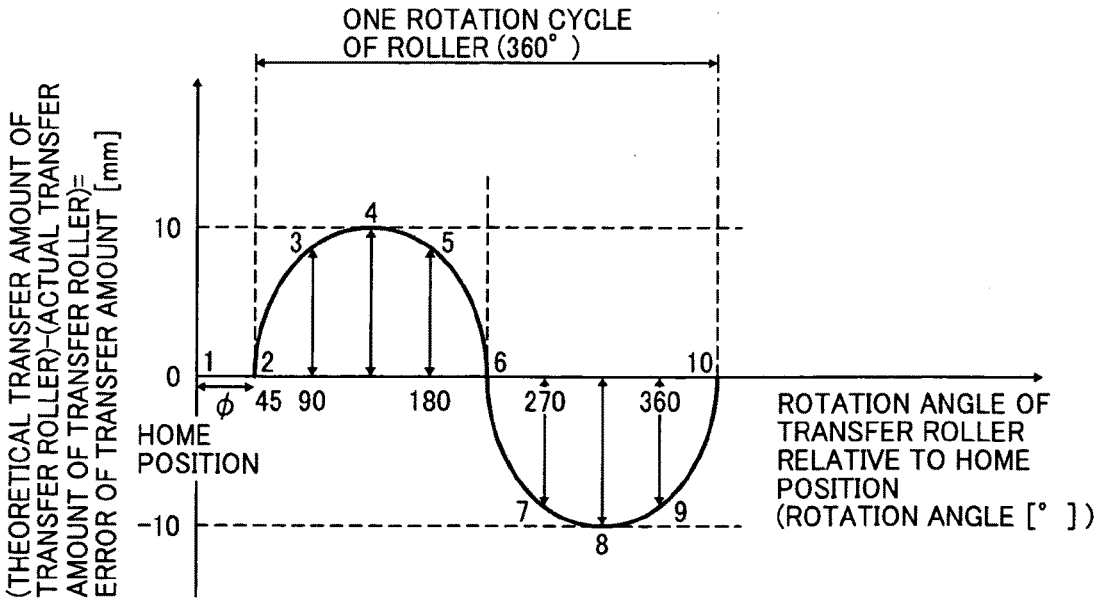

The CPU 40 obtains the difference of the transfer amounts of the transfer roller 15 illustrated in FIG. 12B by calculating the difference between the gap between the actual transfer amount and the gap of the ideal transfer amount (i.e., gap between the actual transfer amount minus gap of the ideal transfer amount) (Step S9).

Since the CPU 40 identifies the gap "1" between the marks 101 printed on the recording medium 16 in advance, the transfer amount (gap of the ideal transfer amount) of the transfer roller 15 having no eccentricity is obtained. Therefore, the CPU 40 can calculate the difference of the transfer amount by the transfer roller 15 according to the following relationship (1) (Step S9). The ideal transfer amount by the transfer roller 15 is represented by the graph (a) illustrated in FIG. 12A.

Difference of transfer amount by transfer roller=(gap between actual transfer amounts)−(gap of ideal transfer amount) Relationship (1)

As illustrated in FIG. 12B, when the rotation angle of the transfer roller 15 having an difference of the transfer amount of 0 from the home position is defined as the eccentricity phase of phi as illustrated in FIG. 12B and the maximum amplitude value of the difference of the transfer amount is set as the amplitude "A" of a sine curve approximation, the difference of the transfer amount by the transfer roller 15 is represented by the following relationship (2):

Difference of transfer amount=$A$×sin(theta−phi) Relationship (2)

Therefore, the relationship of the difference of the transfer amount illustrated in FIG. 12B is represented by the following relationship (3):

Difference of transfer amount=10×sin(theta−45 degree) Relationship (3)

Therefore, the CPU 40 can obtain the difference of the transfer amount by the transfer roller 15.

Next, the CPU 40 calculates the correction amount of the difference of the transfer amount by the transfer roller 15 based on the difference of the transfer amount by the transfer roller 15 as calculated above (Step S10).

Figure 14:
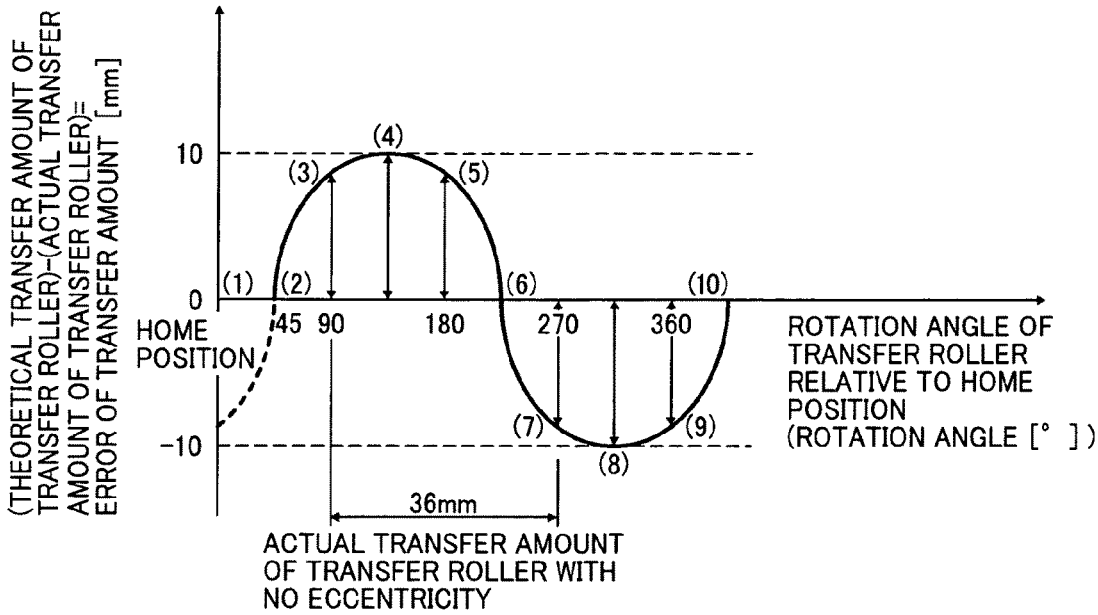
FIG. 14 is a graph illustrating a calculation method for correction amount of difference in the transfer amount by a transfer roller.

For example, as illustrated in FIG. 14, assuming that the current position of the transfer roller 15 is "3", and the transfer roller 15 is rotated until the rotation position of the transfer roller 15 is moved to the target position of the transfer of "7". When the transfer roller 15 has no eccentricity, the transfer amount by the transfer roller 15 is calculated as 36 mm (=54−18) as illustrated in FIG. 12A. However, when the transfer roller 15 has eccentricity, the transfer amount by the transfer roller 15 varies, resulting in the occurrence of the difference of the transfer amount.

Therefore, the CPU 40 calculates the correction amount of the difference of the transfer amount by the transfer roller 15 based on the relationship (3) with regard to the difference of the transfer amount, the information of (3) of the rotation position of the transfer roller 15 before transfer, and the information of (7) of the rotation position of the transfer roller 15 after transfer.

The difference of the transfer amount at the current position of "3" is as follows:

Difference of transfer amount=10×sin(90 degree−45 degree)=10×sin 45 degree=10×0.707=7.07 mm.

The difference of transfer amount at the target position of "7" is as follows:

Difference of transfer amount=10×sin(270 degree−45 degree)=10×sin 225 degree=10×−0.707=−7.07 mm.

Thus, the correction amount of the difference of the transfer amount is as follows:

Correction amount of difference of transfer amount=(difference of transfer amount of target position)−(difference of transfer amount of current position)=(−7.07−7.07)=−14.14 mm.

The CPU 40 sets a target encoder value in the DSP 47 such that the calculated correction amount of the difference of the transfer amount is reflected in the actual transfer amount by the transfer roller 15 and adjusts the rotation angle (transfer angle) of the transfer roller 15. The target encoder value is to make an adjustment such that the transfer amount by the transfer roller 15 reflects the correction amount of the difference of the transfer amount when the rotation angle (transfer angle) of the transfer roller 15 matches the target encoder value.

Thus, the transfer amount reflecting the correction amount of the difference of the transfer amount is as follows:

Transfer amount reflecting correction amount of difference of transfer amount=(transfer amount of transfer roller 15 in the case of no eccentricity)−(Correction amount of difference of transfer amount)=36−(−14.14)=50.14 mm.

The CPU 40 outputs a target encoder value in the DSP 47 such that the actual transfer amount by the transfer roller 15 is 50.14 mm and adjusts the rotation angle (transfer angle) of the transfer roller 15.

Figure 15:
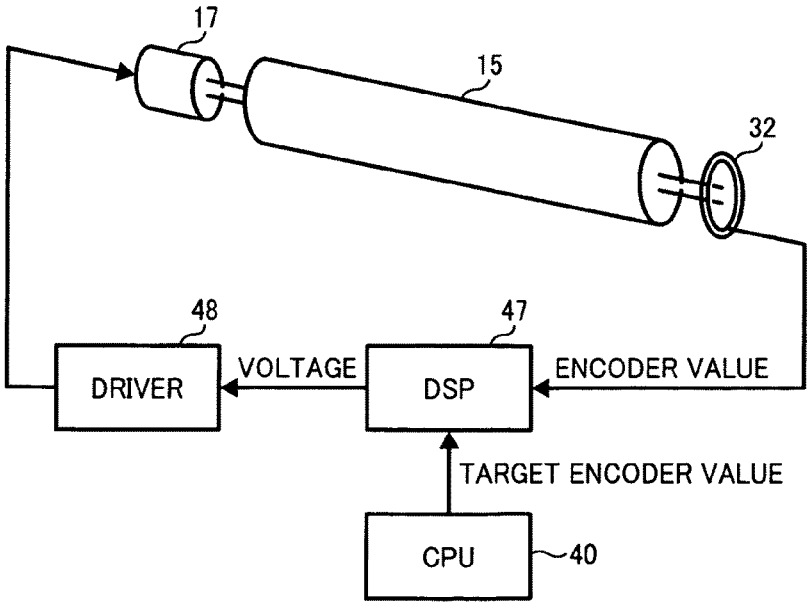
FIG. 15 is a diagram illustrating a processing operation example when the rotation angle of a transfer roller is adjusted.

As illustrated in FIG. 15, the DSP 47 adjusts the voltage of a driver 48 based on the target encoder value input by the CPU 40 and the encoder value counted by the DSP 47. For example, the DSP 47 adjusts the voltage of the driver 48 such that the transfer amount by the transfer roller 15 is 50.14 mm when the encoder value obtained from the sub-scanning encoder 32 matches the target encoder value input by the CPU 40. The driver 48 drives the sub-scanning motor 17 according to the voltage input by the DSP 47, adjusts the rotation angle of the transfer roller 15, and controls the transfer amount per unit of time by the transfer roller 15 to be constant.

Therefore, the CPU 40 calculates the correction amount of the difference of the transfer amount by the transfer roller 15 based on the relationship "3" with regard to the difference of the transfer amount, the information of the rotation position of the transfer roller 15 before transfer, and the information of the rotation position of the transfer roller 15 after transfer. The rotation angle of the transfer roller 15 is adjusted according to the correction amount of the calculated correction amount of the difference of the transfer amount and the transfer amount per unit of time by the transfer roller 15 is made to be constant.

The information on the relationship information illustrated in FIG. 11 is not necessarily pre-set by the CPU 40. It is possible to make the CPU 40 calculate the information at the time of correction. In addition, although the value of the sub-scanning encoder 32 is input in the DSP 47 in the configuration of this embodiment, the value can be input into the FPGA 43 instead.

In addition, the recording device of this embodiment performs the process described above illustrated in FIG. 9 for the medium condition of the recording medium 16 for use in the recording device, and the correction amount for the difference of the transfer amount according to the medium condition is saved in flash memory 41. The administration device administrates the correction amount according to the medium conditions.

The CPU 40 reads the correction amount for the difference of the transfer amount related to the medium condition of the recording medium 16 when the medium condition of the recording medium 16 for use in the recording device is selected from the operation unit (a selection device). Then, the CPU 40 adjusts the rotation angle of the transfer roller 15 based on the read correction amount for the difference of the transfer amount to make the transfer amount per unit of time of the transfer roller 15 constant.

The medium condition of the recording medium 16 includes size (from A0 to A5), thickness, kind, paper quality, and combinations thereof.

The recording device of the present invention discharges ink from any of the multiple nozzles 100 of the recording head 6 to print the marks on 101 while the carriage 5 and the transfer roller 15 are at rest. The recording device detects the multiple marks 101 printed on the recording medium 16 by the reading sensor 30. The recording device calculates the transfer amount corresponding to the mark 101 from the count value thereof detected by the reading sensor 30, and obtains the rotation angle of the transfer roller 15 from the encoder value at the time of detection of the marks 101. Then, the correspondence table illustrated in FIG. 11 that indicates the relationship between the transfer amount corresponding to the mark 101 and the rotation angle of the transfer 15 at the time of the detecting the marks 101 is set up. The recording device calculates the difference of the transfer amount by the transfer roller 15 based on the correspondence table illustrated in FIG. 11 and the correction amount based on this difference. According to the correction amount, the rotation angle of the transfer roller 15 is adjusted.

Therefore, the recording device of the present invention reduces the variation of the transfer amount due to the transfer roller 15 in the sub-scanning direction by excluding the difference (error) due to the movement of the recording head 6 and the reading sensor 30.

Second Embodiment

The second embodiment is described next.

Figure 19:
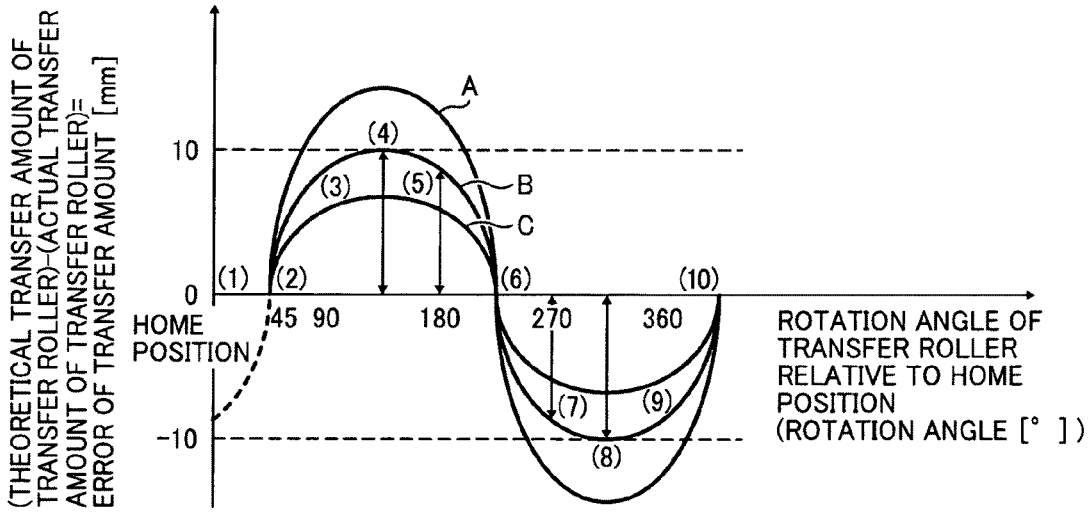
FIG. 19 is graphs illustrating a calculation method for difference in the transfer amount by a transfer roller.
Figure 20A:
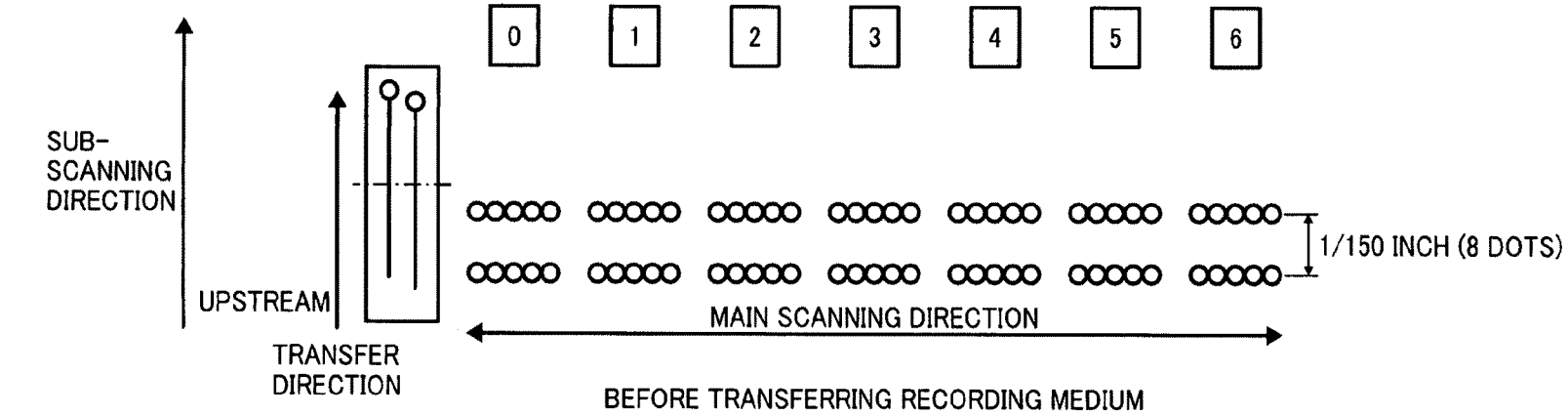
FIG. 20A BACKGROUND ART
FIGS. 20A-20B is a diagram illustrating a background art.
Figure 20B:
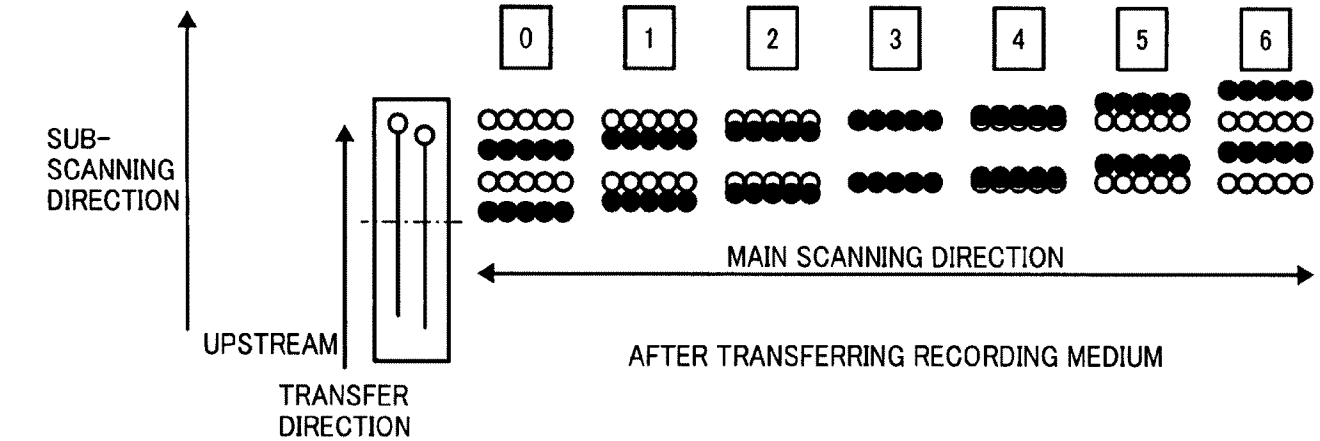
FIG. 20B BACKGROUND ART

In the first embodiment, as illustrated in FIG. 19, the printing process of the marks 101 is repeated (from Step S3/No, to S4 and to S5) until the transfer roller is determined to rotate at least a full circle. In addition, when the transfer roller is determined to rotate at least a full circle (Step S3/Yes), the transfer roller 15 is reversely rotated to move back the recording medium 16 to the measuring start position (Step S6) and then the marks 101 are detected (Step S7) followed by calculation of the correction amount of the difference of the transfer amount by the transfer roller 15 according to the detection results of the marks 101 (Step S8 to S10).

Figure 16:
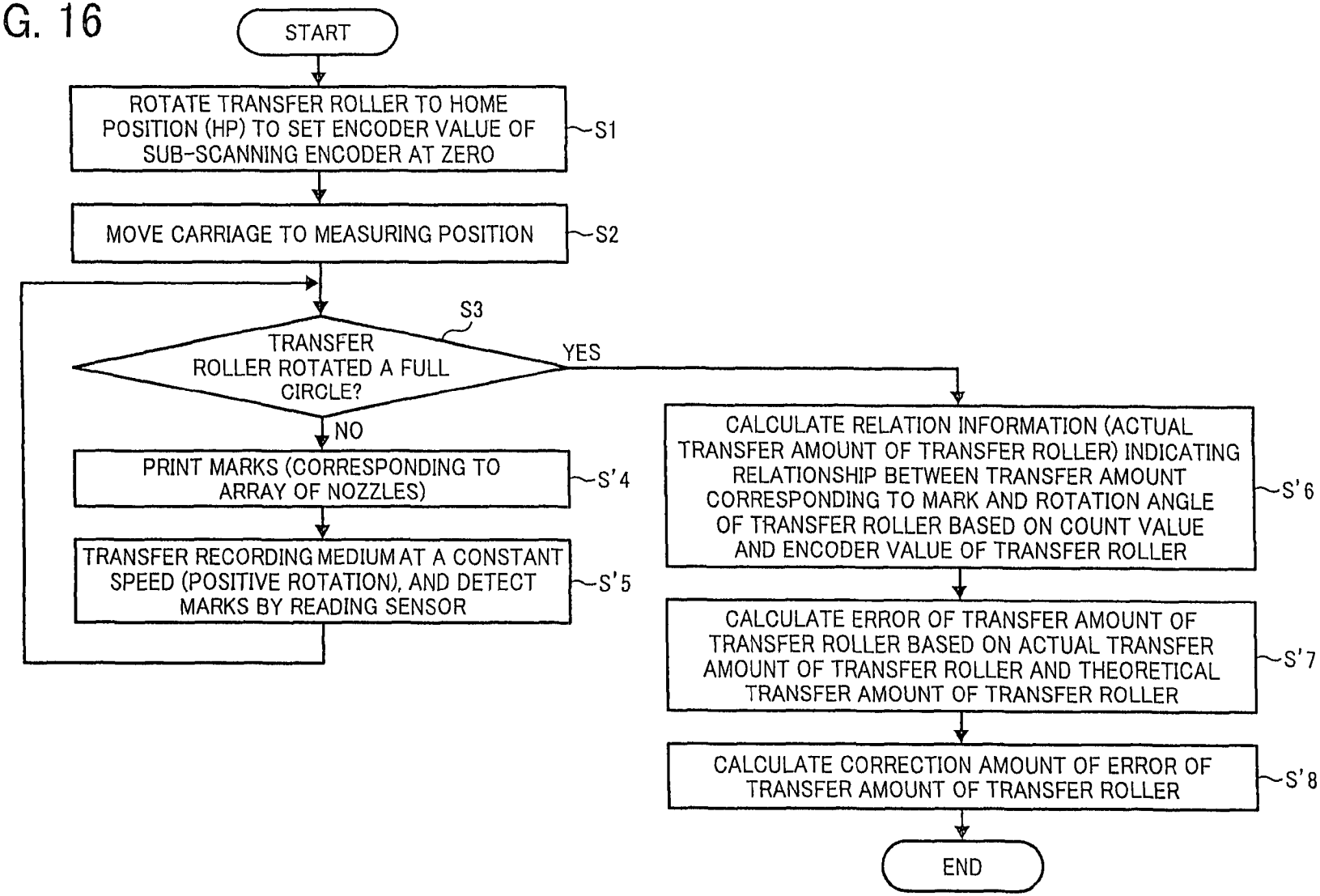
FIG. 16 is a flow chart illustrating a processing example of the recording device of the second embodiment described later.

In the second embodiment, as illustrated in FIG. 16, before he transfer roller is determined to rotate at least a full circle (before Step S3/Yes), the printing process of the marks 101 (Step S'4) and the detection process thereof (Step S'5) are alternately performed. When the transfer roller is determined to rotate at least a full circle (Step S3/Yes), the correction amount of the difference of the transfer amount by the transfer roller 15 is calculated according to the detection results of the marks 101 (Step S'6 to S'8).

Therefore, when the marks 101 are detected, the recording medium 16 is not necessarily moved back to the measuring start point as Step S6 illustrated in FIG. 9. Consequently, the detection process of the marks 101 is more efficiently conducted than the process in the first embodiment.

The embodiments described above are preferable embodiments of the present invention and do not limit the scope of the present invention.

For example, in the embodiments described above, the correction amount of the difference of the transfer amount of the transfer roller 15 is calculated by the detection results obtained by printing the multiple marks 101 on the recording medium 16 and detecting the multiple marks 101 printed on the recording medium 16 by the reading sensor 30. Therefore, it is anticipated that the marks 101 are not printed on the recording medium 16 and/or the marks 101 printed on the recording medium 16 are not detected in some cases.

Figure 17:
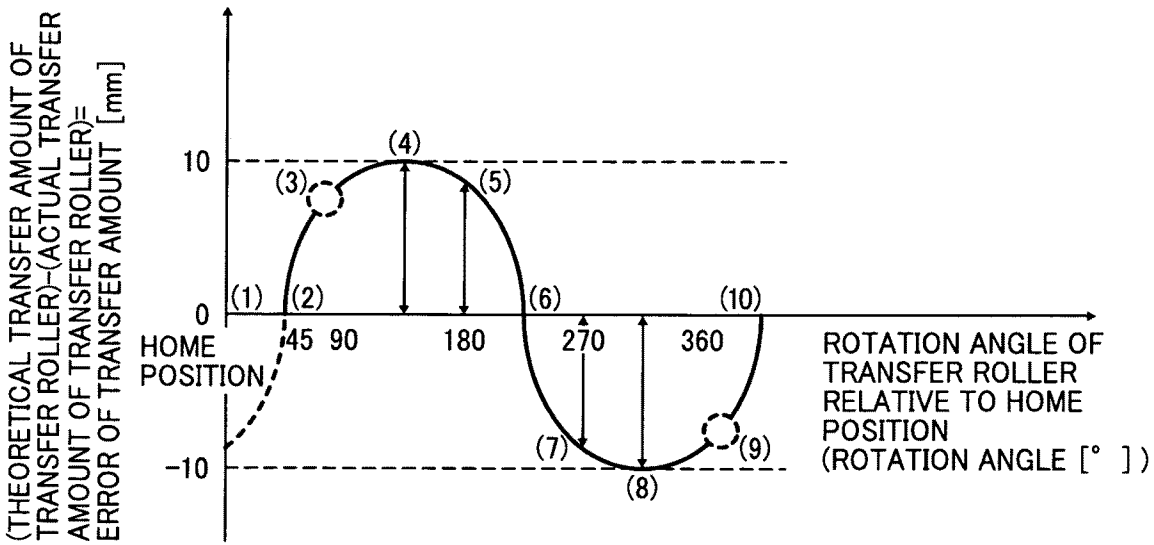
FIG. 17 is graphs illustrating a calculation method for difference in the transfer amount by a transfer roller.

In such cases, the difference of the transfer amount of the transfer roller 15 is not calculated at part of the area (e.g., "3" and "9" illustrated in FIG. 17). However, based on the difference of the transfer amount for the part in which the marks 101 are detected (measuring points of "1", "2", "4" to "8" and "10", the difference of the transfer amount for the part (measuring points of "3" and "9") where the marks 101 are not detected can be calculated by sin curve approximation or straight line approximation. Therefore, the difference of the transfer amount can be obtained even when the marks 101 are not detected at some measuring points.

Figure 18A:
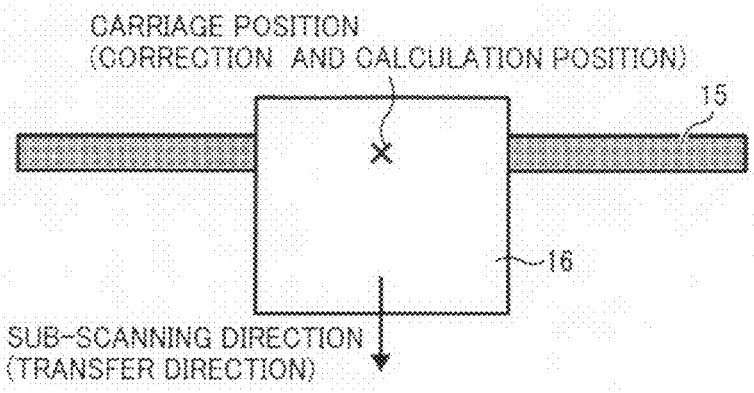
FIGS. 18A-18C is a diagram illustrating the arrangement position of a carriage performing the processes illustrated in FIGS. 9 and 16.

In addition, in the embodiments described above, the printing position (correction amount calculation points) where the marks 101 are printed on the recording medium 16 is set at the center portion of the transfer roller 15 in the main scanning direction as illustrated in FIG. 18A. However, as illustrated in FIG. 183, the printing position can be set at an either end of the transfer roller 15 in the main scanning direction.

Figure 18B:
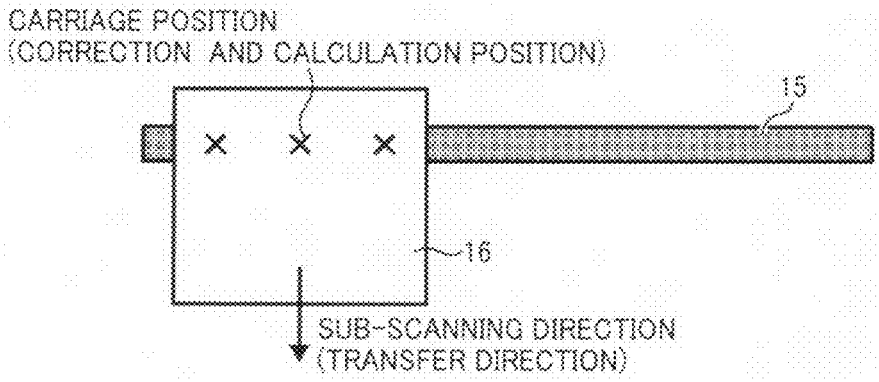

That is, when the center portion of the transfer roller 15 touches the recording medium 16, the carriage 5 is preferably arranged at the center portion as to the width direction of the recording medium 16 as illustrated in FIG. 18A. In addition, when the end portion of the recording medium 16 is used as the reference of the transfer, the carriage 5 is preferably arranged at the end portion as to the width direction of the recording medium 16 as illustrated in FIG. 18B.

In addition, in the embodiments described above, the process of correcting the transfer position (process of correcting the transfer amount variation based on a cycle defined as a full circle of the transfer roller 15) is performed at one point somewhere in the main scanning direction of the transfer roller 15.

However, when the transfer roller 15 is a long roller to deal with a size of A0, the transfer amount variation based on a cycle defined as a full circle of the transfer roller 15 may be different depending on the point in the main scanning direction of the transfer roller 15.

Figure 18C:
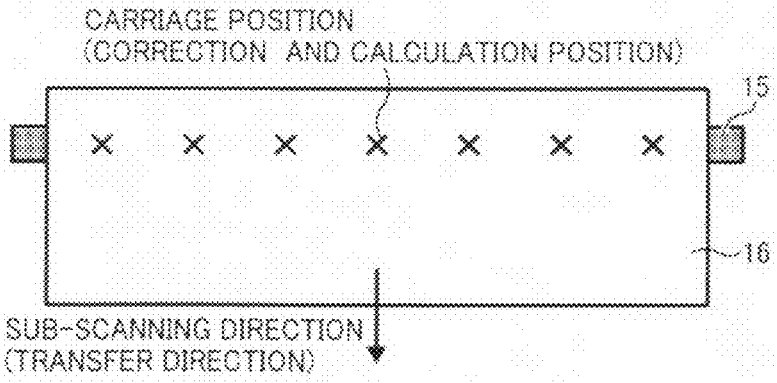

Therefore, the correction process of the transfer deviation (processes of correcting the transfer amount variation based on a cycle defined as a full circle of the transfer roller 15) illustrated in FIGS. 9 and 16 is preferably performed at multiple points in the main scanning direction as illustrated in FIG. 18C. Thus, the eccentricity of the transfer roller 15 is corrected by setting up the correction amount suitable to the medium condition of the recording medium used for printing.

When the correction process of the transfer deviation (processes of correcting the transfer amount variation based on a cycle defined as a full circle of the transfer roller 15) is performed at multiple points in the main scanning direction, the recording medium 16 is transferred back after one correction process of the transfer deviation (process of correcting the transfer amount variation based on a cycle defined as a full circle of the transfer roller 15) and the next correction process is preferably performed at the adjacent position (in the main scanning direction) not to waste the recording medium 16.

Furthermore, when the correction processes of the transfer deviation (processes of correcting the transfer amount variation based on a cycle defined as a full circle of the transfer roller 15) are performed at multiple points in the main scanning direction, the average (average in the main scanning direction: (A+B+C)/3) of the correction values obtained in the processes described above or a representative value such as the maximum value A, and the minimum value C illustrated in FIG. 19 is preferably used as the correction value depending on the situation.

In addition, the processes illustrated in FIGS. 9 and 16 can be started when the start button is pressed. Also, the process can be set to start upon power-on of the recording device or a change of the environment where the recording device is placed. The change of the environment can be recognized by, for example, using a method of detecting the time when a temperature change measured by a temperature sensor in the recording device surpasses a predetermined threshold.

In addition, each part constituting the recording device in the embodiments described above can be controlled by using hardware, software or a combination of both.

In the case of software, a program in which the process sequence is recorded is installed in the memory in a computer integrated in exclusive hardware. Alternatively, the program can be installed in a universal computer that performs various kinds of processes.

For example, the program can be preliminarily recorded in a hard disc or read only memory (ROM) functioning as recording media. Alternatively, the program can be temporarily or permanently stored in a removable recording medium. Such removable recording media can be provided as a package software. Specific examples of such removable recording media include, but are not limited to, a floppy disks, a compact disc read only memory (CD-ROM), a magneto optical (MO) disc, a digital versatile disc (DVD), a magnetic disc, and a semiconductor memory.

The program is installed from the removable media mentioned above to a computer. In addition, the program can be also wireless transferred from a download site. In addition, the program can be also transferred with fixed lines using a network.

The recording device of the embodiments performs the processes described above sequentially. In addition, the recording device can be structured to perform processing in parallel or individually based on the processing power of each device or on a necessity basis.

This document claims priority and contains subject matter related to Japanese Patent Application No. 2009-061920 filed on Mar. 13, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A recording device comprising:

a carriage head;

a recording head installed onto the carriage head, the recording head having an array of nozzles that discharges ink on a recording medium;

a transfer roller that transfers the recording medium in a direction along the array of nozzles;

a control device that controls rotation of the transfer roller;

a first detection device that detects a rotation position of the transfer roller; and a second detection device that detects marks printed on the recording medium by the recording head, the control device comprising:

a print control device that controls printing the marks on the recording medium in the direction along the array of nozzles from the array of nozzles of the recording head while the carriage head and the transfer roller remain still;

a calculation device that calculates a correction amount for use in correction of a rotation angle of the transfer roller according to a difference between an actual transfer amount of the recording medium by the transfer roller at a predetermined rotation position obtained by detection of the marks by the second detection device while the transfer roller is in rotation and a theoretical transfer amount of the recording medium at the predetermined rotation position; and a correction device that corrects the rotation angle of the transfer roller using the correction amount.

2. The recording device according to claim 1, further comprising an administration device that administrates the correction amount calculated by the calculation device according to medium conditions of the recording medium, and a selection device that selects the medium conditions of the recording medium for use in image formation, and wherein the correction device determines the correction amount corresponding to the medium conditions selected by the selection device while referring to the administration device and controls the rotation angle of the transfer roller using the correction amount determined.

3. The recording device according to claim 1, wherein, after the marks are printed on the recording medium, the print control device repeats a process of transferring the recording medium by a positive rotation of the transfer roller in a predetermined rotation amount and a process of printing the marks on the recording medium in the direction along the array of nozzles, thereafter the second detection device detects the marks, and then the calculation device obtains the difference between the actual transfer amount of the recording medium at the predetermined rotation position obtained by detection of the marks by the second detection device and the theoretical transfer amount of the recording medium at the predetermined rotation position by relating to the predetermined rotation position of the transfer roller.

4. The recording device according to claim 1, wherein, after the marks are printed on the recording medium, the print control device repeats a process of transferring the recording medium by rotation of the transfer roller in a predetermined rotation amount and a process of printing the marks on the recording medium in the direction along the array of nozzles, the second detection device detects the marks while the print control device transfers the recording medium, and the calculation device obtains the difference between the actual transfer amount of the recording medium at the predetermined rotation position obtained by detection of the marks by the second detection device while the printing device transfers the recording medium and the theoretical transfer amount of the recording medium at the predetermined rotation position by relating to the predetermined rotation position of the transfer roller.

5. The recording device according to claim 1, wherein the calculation device determines a first difference corresponding to a current rotation position of the transfer roller and a second difference corresponding to the predetermined rotation position of the transfer roller after rotation according to a relationship between the current rotation position of the transfer roller and the difference between the actual transfer amount and the theoretical transfer amount, and calculates the correction amount by a difference between the first difference and the second difference.

6. The recording device according to claim 5, wherein the correction device determines a transfer amount obtained by subtracting the correction amount from a theoretical transfer amount of the transfer roller between the current rotation position of the transfer roller and the rotation position of the transfer roller after rotation as an actual transfer amount by the transfer roller, and the control device controls rotation of the transfer roller in such a manner that the transfer amount of the transfer roller matches the actual transfer amount by the transfer roller.

7. The recording device of claim 1, wherein the array of nozzles is configured to discharge one or more of black ink, cyan ink, magenta ink, and yellow ink.

8. The recording device of claim 1, wherein the array of nozzles is configured to discharge black ink, cyan ink, magenta ink, and yellow ink.

9. The recording device of claim 1, wherein the first detection device comprises a sub-scanning encoder.

10. The recording device of claim 1, wherein the second detection device comprises a reading sensor.

11. The recording device of claim 10, wherein the reading sensor comprises:

a luminous portion; and a light reception portion.

12. The recording device of claim 1, wherein the transfer roller is configured to transfer the recording medium in a sub-scanning direction of the recording device.

13. The recording device of claim 1, wherein the carriage head is configured to move in a main scanning direction of the recording device.

14. The recording device of claim 1, wherein the array of nozzles is aligned with a sub-scanning direction of the recording device.

15. The recording device of claim 1, wherein the difference between the actual transfer amount the theoretical transfer amount includes a fixed component.

16. The recording device of claim 1, wherein the difference between the actual transfer amount the theoretical transfer amount includes a variable component.

17. The recording device of claim 1, wherein the difference between the actual transfer amount the theoretical transfer amount includes both a fixed component and a variable component.

18. A method of controlling a recording device that comprises a carriage head, a recording head installed onto the carriage head, the recording head having an array of nozzles that discharges ink on a recording medium, a transfer roller that transfers the recording medium in a direction along the array of nozzles, a control device that controls the transfer roller, a first detection device that detects a rotation position of the transfer roller, and a second detection device that detects marks printed on the recording medium by the recording head, the method comprising:

discharging ink from the array of nozzles of the recording head installed onto the carriage head to print the marks on the recording medium in the direction along the array of nozzles while the carriage head and the transfer roller remain at rest;

calculating a correction amount for use in correction of a rotation angle of the transfer roller according to a relationship between an actual transfer amount of the recording medium by the transfer roller at a predetermined rotation position obtained by detection of the marks by the second detection device while the transfer roller is in rotation and a theoretical transfer amount of the recording medium at the predetermined rotation position; and correcting the rotation angle of the transfer roller using the correction amount.

19. A computer-readable recording medium storing a computer program for executing a control method for a recording device that comprises a carriage head, a recording head installed onto the carriage head, the recording head having an array of nozzles that discharges ink on a recording medium, a transfer roller that transfers the recording medium in a direction along the array of nozzles, a control device that controls the transfer roller, a first detection that detects a rotation position of the transfer roller, and a second detection device that detects marks printed on the recording medium by the recording head, the control method comprising:

discharging ink from the array of nozzles of the recording head installed onto the carriage head to print the marks on the recording medium in the direction along the array of nozzles while the carriage head and the transfer roller remain at rest;

calculating a correction amount for use in correction of a rotation angle of the transfer roller according to a relationship between an actual transfer amount of the recording medium by the transfer roller at a predetermined rotation position obtained by detection of the marks by the second detection device while the transfer roller is in rotation and a theoretical transfer amount of the recording medium at the predetermined rotation position; and correcting the rotation angle of the transfer roller using the correction amount.

* * * * *